US006601512B2

(12) United States Patent
Yamamoto et al.

(10) Patent No.: US 6,601,512 B2
(45) Date of Patent: Aug. 5, 2003

(54) METHOD OF FEEDING DAMPENING WATER IN A PRINTING MACHINE

(75) Inventors: Takaharu Yamamoto, Kyoto (JP); Nobuhito Kohara, Kyoto (JP); Satoru Kiyohara, Kyoto (JP)

(73) Assignee: Dainippon Screen Mfg., Co., Ltd., Kyoto (JP)

( * ) Notice: Subject to any disclaimer, the term of this patent is extended or adjusted under 35 U.S.C. 154(b) by 0 days.

(21) Appl. No.: 10/102,808

(22) Filed: Mar. 22, 2002

(65) Prior Publication Data

US 2002/0139272 A1 Oct. 3, 2002

(30) Foreign Application Priority Data

Mar. 29, 2001 (JP) ..... 2001-094697
Oct. 15, 2001 (JP) ..... 2001-316296

(51) Int. Cl.[7] ..... B41L 5/12; B41F 31/02

(52) U.S. Cl. ..... 101/484; 101/130; 101/147; 101/148; 101/335; 101/364; 101/365; 101/483; 101/484; 101/492

(58) Field of Search ..... 101/484, 483, 101/492, 335, 364, 365, 130, 147, 148

(56) References Cited

U.S. PATENT DOCUMENTS 4,947,348 A * 8/1990 Van Arsdell ..... 358/1.9
4,972,774 A * 11/1990 MacPhee ..... 101/450.1
5,791,249 A * 8/1998 Quadracci ..... 101/450.1

FOREIGN PATENT DOCUMENTS

JP 07-266547 10/1995
JP 2831107 9/1998

* cited by examiner

*Primary Examiner*—Andrew H. Hirshfeld
*Assistant Examiner*—Hoai-An D. Nguyen
(74) *Attorney, Agent, or Firm*—McDermott, Will & Emery

(57) ABSTRACT

A method of feeding dampening water includes a density measuring step for measuring densities of first and second detecting patches 101 and 102 printed adjacent each other on printed matter 100 and presenting a difference in density variations after printing with varied feed rates of damping water and ink, a dampening water feeding step for controlling the feed rate of dampening water based on the densities of the first and second detecting patches 101 and 102 measured in the density measuring step, and an ink feeding step for controlling the feed rate of ink based on the densities of the first and second detecting patches measured in the density measuring step, and the feed rate of dampening water.

16 Claims, 18 Drawing Sheets

METHOD OF FEEDING DAMPENING WATER IN A PRINTING MACHINE

BACKGROUND OF THE INVENTION

1. Field of the Invention

The present invention relates to methods of feeding dampening water in a printing machine.

2. Description of the Related Art

In a printing machine, the feed rates of dampening water and ink have a crucial influence on printing results. It is therefore necessary for the printing machine to adjust the feed rates of dampening water and ink properly.

To execute a method of automatically detecting the quantities of dampening water and ink and controlling the feed rates thereof, an apparatus has been proposed, for example, that measures a film thickness of ink and a film thickness of water on an ink kneading roller by using an infrared sensor or the like. However, such an apparatus presents difficulties in coping with environmental changes occurring in time of printing, and the apparatus itself is extremely expensive.

In Japanese Patent No. 2831107, a tone controlling apparatus has been proposed that detects densities of a solid portion and a halftone portion of a print, performs a comparison operation on the detected densities of the solid portion and halftone portion in relation to target densities of the solid portion and halftone portion inputted beforehand based on density variation characteristics of the solid portion and halftone portion occurring with variations in the feed rates of ink and dampening water, and simultaneously controls the feed rates of ink and dampening water based on results of the comparison operation.

There is a close relationship between the feed rate of dampening water and the feed rate of ink. As described in Patent No. 2831107, when the feed rate of dampening water and the feed rate of ink are varied simultaneously, the two influence each other and often fail to attain desired density values.

A printing machine has far more ink rollers for feeding ink to printing plates than water rollers for feeding dampening water to the printing plates. Thus, an adjustment of dampening water is reflected on printed matter in a shorter time than an adjustment of ink. As described in Patent No. 2831107, rather than adjusting dampening water and ink simultaneously, it is desirable to adjust the feed rate of dampening water first, and then to adjust the feed rate of ink while taking influences of the water adjustment into account.

Further, a printing machine can adjust the feed rate of ink for each predetermined area, but generally cannot adjust the feed rate of dampening water for each such area. However, the apparatus described in Patent No. 2831107 has, as a prerequisite, to adjust the feed rate of dampening water for each predetermined area. Such an adjusting method is difficult to implement with usual printing machines.

SUMMARY OF THE INVENTION

An object of the present invention, therefore, is to provide a method of feeding dampening water in a printing machine, that is capable of properly adjusting the feed rate of dampening water or ink.

The above object is fulfilled, according to the present invention, by a method of feeding dampening water in a printing machine for controlling a feed rate of dampening water along with a feed rate of ink by using first and second detecting patches printed adjacent each other on printed matter and presenting a difference in density variations after printing with varied feed rates of damping water and ink, the method comprising a density measuring step for measuring densities of the first and second detecting patches, a dampening water feeding step for controlling the feed rate of dampening water based on the densities of the first and second detecting patches measured in the density measuring step, and an ink feeding step for controlling the feed rate of ink based on the densities of the first and second detecting patches measured in the density measuring step, and the feed rate of dampening water.

In another aspect of the invention, there is provided a method of feeding dampening water in a printing machine for controlling a feed rate of dampening water along with a feed rate of ink by using two types of detecting patches printed adjacent each other in areas, L in number, arranged in a direction of width of printed matter and presenting a difference in density variations after printing with varied feed rates of damping water and ink, wherein one of the two types of detecting patches that has a large halftone area ratio comprises first detecting patches, while the other of the two types of detecting patches that has a small halftone area ratio comprises second detecting patches, the method comprising a critical density measuring step for measuring a critical density DM at which a shortage of dampening water causes a defective print, from prints obtained by performing printing a plurality of times while varying the feed rate of dampening water, a preparatory density measuring step for measuring a density D1$x$ of the first detecting patches and a density D2$x$ of the second detecting patches from each of prints obtained by performing printing a plurality of times while varying the feed rate of ink, a multiple linear regression step for deriving coefficients a, b and c from an equation (1) set out below and representing a parameter Dwx, by multiple linear regression, using the critical density DM measured in the critical density measuring step, and the density D1$x$ of the first detecting patches and the density D2$x$ of the second detecting patches measured in the preparatory density measuring step in time of each printing, a density measuring step for measuring a density D1$x$ of each of the first detecting patches and a density D2$x$ of each of the second detecting patches arranged in the areas, from printed matter obtained by trial printing, a parameter computing step for computing the parameter Dwx for each of the areas, by using the equation (1) set out below, from the coefficients a, b and c obtained in the multiple linear regression step, and the density D1$x$ of each of the first detecting patches and the density D2$x$ of each of the second detecting patches obtained in the density measuring step, a dampening water feed rate adjusting step for adjusting the feed rate of dampening water based on a minimum parameter minDwx of parameters Dwx for the areas obtained in the parameter computing step, an adjusted ink feed rate computing step for computing an adjusted ink feed rate a for each of the areas, by using an equation (2) set out below and representing the adjusted ink feed rate α, from a target density DT, the critical density DM obtained in the critical density measuring step, the parameter Dwx for each of the areas obtained in the parameter computing step, and the minimum parameter minDwx of parameters Dwx for the areas obtained in the parameter computing step, and an ink feed rate adjusting step for adjusting the feed rate of ink for each of the areas based on the adjusted ink feed rate α obtained in the adjusted ink feed rate computing step:

$$Dwx=DM-\mathrm{D1}x=a\cdot\mathrm{D1}x+b\cdot\mathrm{D2}x+c \quad (1)$$

$$\alpha=DT-DM+(Dwx-\min Dwx) \quad (2)$$

In a further aspect of the invention, there is provided a method of feeding dampening water in a printing machine for controlling a feed rate of dampening water along with a feed rate of ink by using three types of detecting patches printed adjacent one another in areas, L in number, arranged in a direction of width of printed matter and presenting differences in density variations after printing with varied feed rates of damping water and ink, wherein one of the three types of detecting patches that has a large halftone area ratio comprises first detecting patches, another of the three types of detecting patches that has a smaller halftone area ratio than the first detecting patches comprises second detecting patches, and the remaining type of detecting patches that has a smaller halftone area ratio than the first detecting patches and a different resolution to the second detecting patches comprise third detecting patches, the method comprising a critical density measuring step for measuring a critical density DM at which a shortage of dampening water causes a defective print, from prints obtained by performing printing a plurality of times while varying the feed rate of dampening water, a preparatory density measuring step for measuring a density D1*x* of the first detecting patches, a density D2*x* of the second detecting patches a density D3*x* of the third detecting patches from each of prints obtained by performing printing a plurality of times while varying the feed rate of ink, a multiple linear regression step for deriving coefficients d, e, f and g from an equation (3) set out below and representing a parameter Dwx, by multiple linear regression, using the critical density DM measured in the critical density measuring step, and the density D1*x* of the first detecting patches, the density D2*x* of the second detecting patches and the density D3*x* of the third detecting patches measured in the preparatory density measuring step in time of each printing, a density measuring step for measuring a density D1*x* of each of the first detecting patches, a density D2*x* of each of the second detecting patches and a density D3*x* of each of the third detecting patches arranged in the areas, from printed matter obtained by trial printing, a parameter computing step for computing the parameter Dwx, by using the equation (3) set out below, from the coefficients d, e, f and g obtained in the multiple linear regression step, and the density D1*x* of each of the first detecting patches, the density D2*x* of each of the second detecting patches and the density D3*x* of each of the third detecting patches obtained in the density measuring step, a dampening water feed rate adjusting step for adjusting the feed rate of dampening water based on the parameters Dwx obtained in the parameter computing step, and an ink feed rate adjusting step for adjusting the feed rate of ink based on a target density DT, and the parameter Dwx obtained in the parameter computing step:

$$Dwx=DM-\mathrm{D1}x=d\cdot\mathrm{D1}x+e\cdot\mathrm{D2}x+f\cdot\mathrm{D3}x+g \quad (3)$$

In a still further aspect of the invention, there is provided a method of feeding dampening water in a printing machine for controlling a feed rate of dampening water by using two types of detecting patches printed adjacent each other on printed matter and presenting a difference in density variations after printing with varied feed rates of damping water, wherein the two types of detecting patches comprise first detecting patches having a halftone area ratio at substantially 100%, and second detecting patches having a halftone area ratio at K×100% (K being a coefficient larger than 0 and smaller than 1), the method comprising: a density measuring step for measuring a reflection density Ds of the first detecting patches and a reflection density Dm from the printed matter, a coefficient computing step for computing a coefficient N, by using Yule-Nielsen's equation (4) set out below, from results of measurement obtained in the density measuring step, and a dampening water feed rate adjusting step for adjusting the feed rate of dampening water based on the coefficient N:

$$Dm=-N\cdot Log\{1-K(1-10^{(-Ds/N)})\} \quad (4)$$

The above methods of feeding dampening water enable a proper adjustment of the feeding rate(s) of dampening water and/or ink.

Other features and advantages of the present invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Embodiments of the present invention will be described hereinafter with reference to the drawings.

[First Embodiment]

Figure 1:
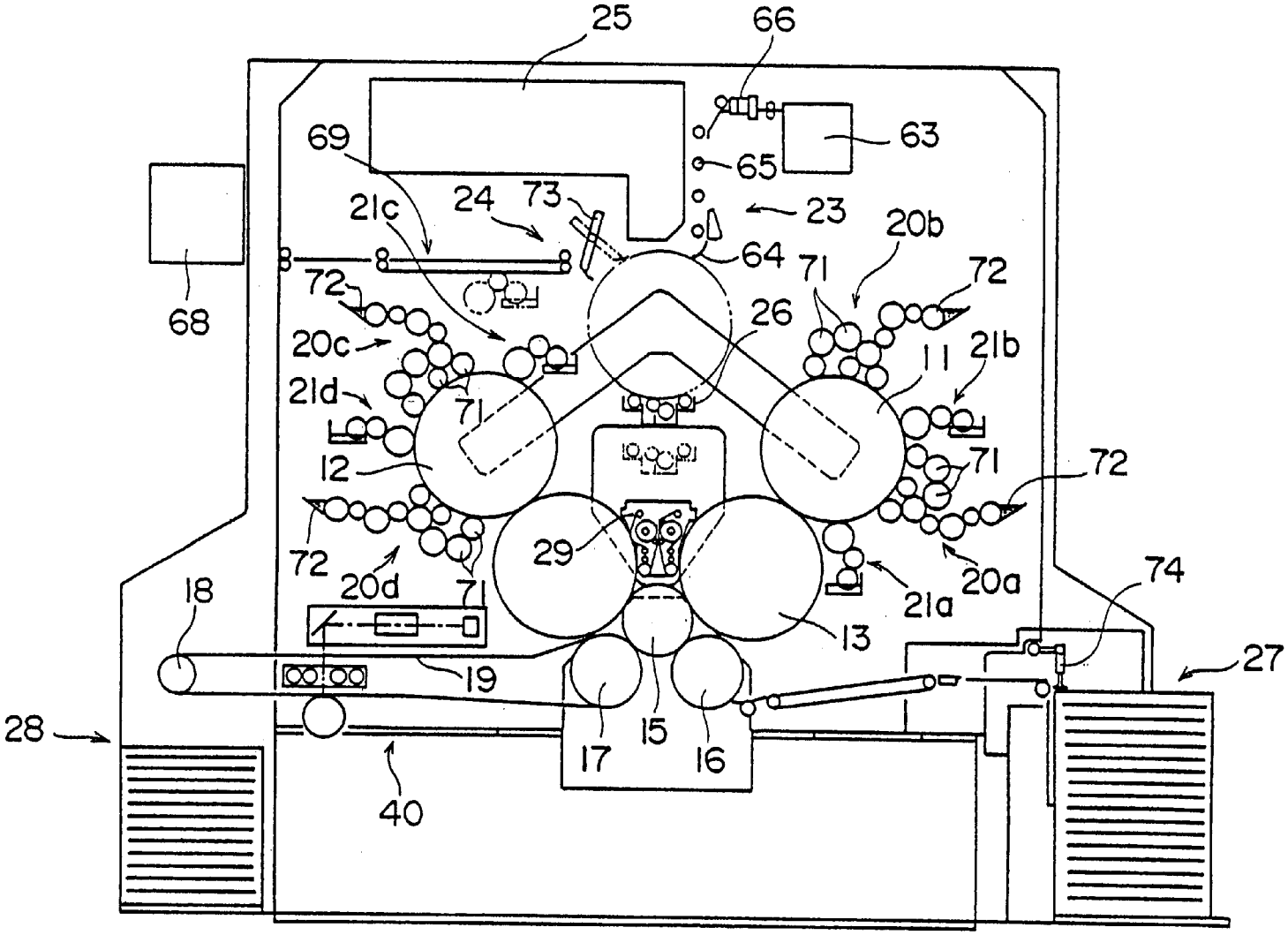
FIG. 1 is a schematic side view of a printing apparatus to which the invention is applied.

FIG. 1 is a schematic side view of a printing apparatus to which the present invention is applied.

This printing apparatus records images on blank plates mounted on first and second plate cylinders 11 and 12, feeds inks to the plates having the images recorded thereon, and transfers the inks from the plates through first and second blanket cylinders 13 and 14 to printing paper held on an impression cylinder 15, thereby printing the images on the printing paper.

The first plate cylinder 11 is movable between a first printing position shown in a solid line and an image recording position shown in a two-dot chain line in FIG. 1. The second plate cylinder 12 is movable between a second printing position shown in a solid line in FIG. 1 and the same image recording position.

Around the first plate cylinder 11 in the first printing position are an ink feeder 20*a* for feeding an ink of black (K), for example, to the plate, an ink feeder 20*b* for feeding an ink of magenta (M), for example, to the plate, and dampening water feeders 21*a* and 21*b* for feeding dampening water to the plate. Around the second plate cylinder 12 in the second printing position are an ink feeder 20*c* for feeding an ink of cyan (C), for example, to the plate, an ink feeder 20*d* for feeding an ink of yellow (Y), for example, to the plate, and dampening water feeders 21*c* and 21*d* for feeding dampening water to the plate. Further, around the first or second plate cylinder 11 or 12 in the image recording position are a plate feeder 23, a plate remover 24, an image recorder 25 and a developing device 26.

The first blanket cylinder 13 is contactable with the first plate cylinder 11, while the second blanket cylinder 14 is contactable with the second plate cylinder 12. The impression cylinder 15 is contactable with the first and second blanket cylinders 13 and 14 in different positions. The apparatus further includes a paper feed cylinder 16 for transferring printing paper supplied from a paper storage 27 to the impression cylinder 15, a paper discharge cylinder 17 with chains 19 wound thereon for discharging printed paper from the impression cylinder 15 to a paper discharge station 28, an image pickup station 40 for measuring densities of detecting patches printed on the printing paper, and a blanket cleaning unit 29.

Each of the first and second plate cylinders 11 and 12 is coupled to a plate cylinder moving mechanism not shown, and driven by this moving mechanism to reciprocate between the first or second printing position and the image recording position. In the first printing position, the first plate cylinder 11 is driven by a motor not shown to rotate synchronously with the first blanket cylinder 13. In the second printing position, the second plate cylinder 12 is rotatable synchronously with the second blanket cylinder 14. Adjacent the image recording position is a plate cylinder rotating mechanism, not shown, for rotating the first or second plate cylinder 11 or 12 whichever is in the image recording position.

The plate feeder 23 and plate remover 24 are arranged around the first or second plate cylinder 11 or 12 in the image recording position.

The plate feeder 23 includes a supply cassette 63 storing a roll of elongate blank plate in light-shielded state, a guide member 64 and guide rollers 65 for guiding a forward end of the plate drawn from the cassette 63 to the surface of the first or second plate cylinder 11 or 12, and a cutter 66 for cutting the elongate plate into sheet plates. Each of the first and second plate cylinders 11 and 12 has a pair of grippers, not shown, for gripping the forward and rear ends of the plate fed from the plate feeder 23.

The plate remover 24 has a pawl mechanism 73 for separating a plate from the first or second plate cylinder 11 or 12 after a printing operation, a discharge cassette 68, and a conveyor mechanism 69 for transporting the plate separated by the pawl mechanism 73 to the discharge cassette 68.

The forward end of the plate drawn from the feeder cassette 63 is guided by the guide rollers 65 and guide member 64, and gripped by one of the grippers on the first or second plate cylinder 11 or 12. Then, the first or second plate cylinder 11 or 12 is rotated by the plate cylinder rotating mechanism not shown, whereby the plate is wrapped around the first or second plate cylinder 11 or 12. The rear end of the plate cut by the cutter 66 is gripped by the other gripper. While, in this state, the first or second plate cylinder 11 or 12 is rotated at low speed, the image recorder 25 irradiates the surface of the plate mounted peripherally of the first or second plate cylinder 11 or 12 with a modulated laser beam for recording images thereon.

Figure 2A:
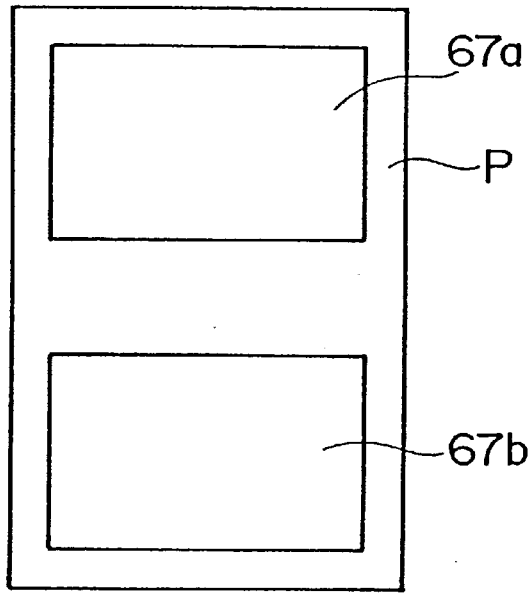
FIGS. 2A and 2B are explanatory views each showing an arrangement of image areas on a printing plate.
Figure 2B:
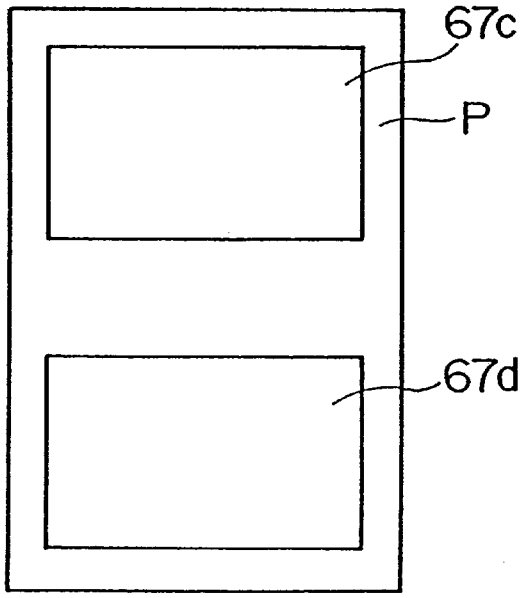

On the plate P mounted peripherally of the first plate cylinder 11, the image recorder 25, as shown in FIG. 2A, records an image area 67*a* to be printed with black ink, and an image area 67*b* to be printed with magenta ink. On the plate P mounted peripherally of the second plate cylinder 12, the image recorder 25, as shown in FIG. 2B, records an image area 67*c* to be printed with cyan ink, and an image area 67*d* to be printed with yellow ink. The image areas 67*a* and 67*b* are recorded in evenly separated positions, i.e. in positions separated from each other by 180 degrees, on the plate P mounted peripherally of the first plate cylinder 11. Similarly, the image areas 67*c* and 67*d* are recorded in evenly separated positions, i.e. in positions separated from each other by 180 degrees, on the plate P mounted peripherally of the second plate cylinder 12.

Referring again to FIG. 1, the ink feeders 20*a* and 20*b* are arranged around the first plate cylinder 11 in the first printing position, while the ink feeders 20*c* and 20*d* are arranged around the second plate cylinder 12 in the second printing position, as described hereinbefore. Each of these ink feeders 20*a*, 20*b*, 20*c* and 20*d* (which may be referred to collectively as "ink feeders 20") includes a plurality of ink rollers 71 and an ink source 72.

The ink rollers 71 of the ink feeders 20*a* and 20*b* are swingable by action of cams or the like not shown. With the swinging movement, the ink rollers 71 of the ink feeder 20*a* or 20*b* come into contact with one of the two image areas 67*a* and 67*b* formed on the plate P mounted peripherally of the first plate cylinder 11. Thus, the ink is fed only to an intended one of the image areas 67*a* and 67*b*. Similarly, the ink rollers 71 of the ink feeders 20*c* and 20*d* are swingable by action of cams or the like not shown. With the swinging movement, the ink rollers 71 of the ink feeder 20*c* or 20*d* come into contact with one of the two image areas 67*c* and 67*d* formed on the plate P mounted peripherally of the second plate cylinder 12. Thus, the ink is fed only to an intended one of the image areas 67*c* and 67*d*.

Figure 3:
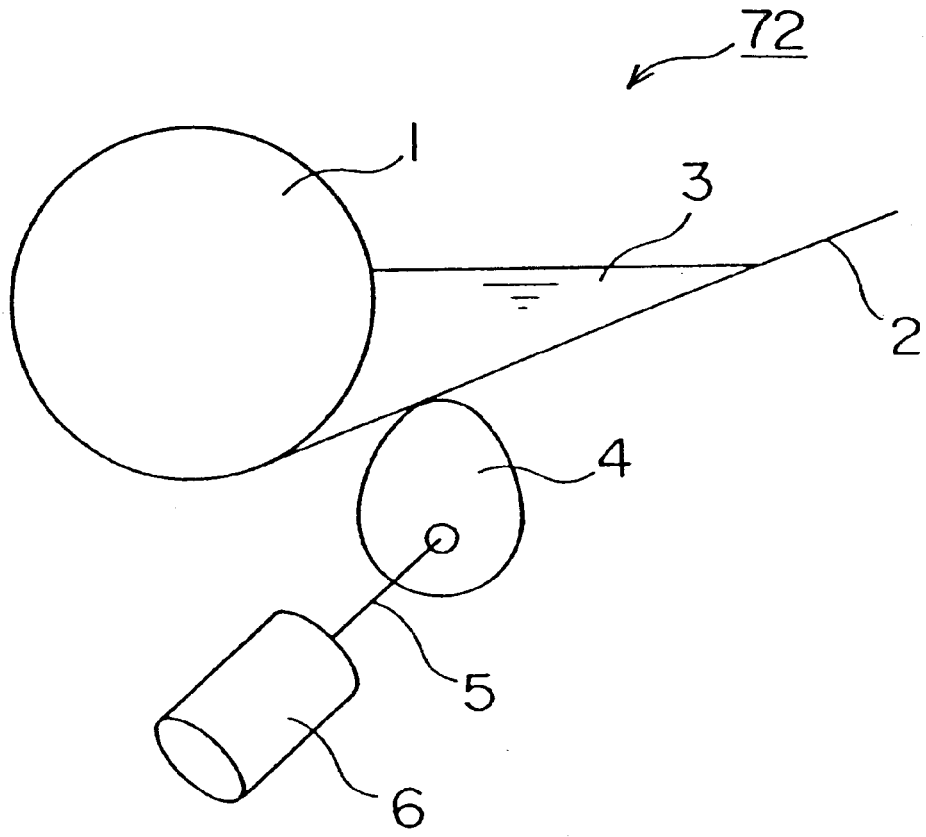
FIG. 3 is a schematic side view of an ink source.
Figure 4:
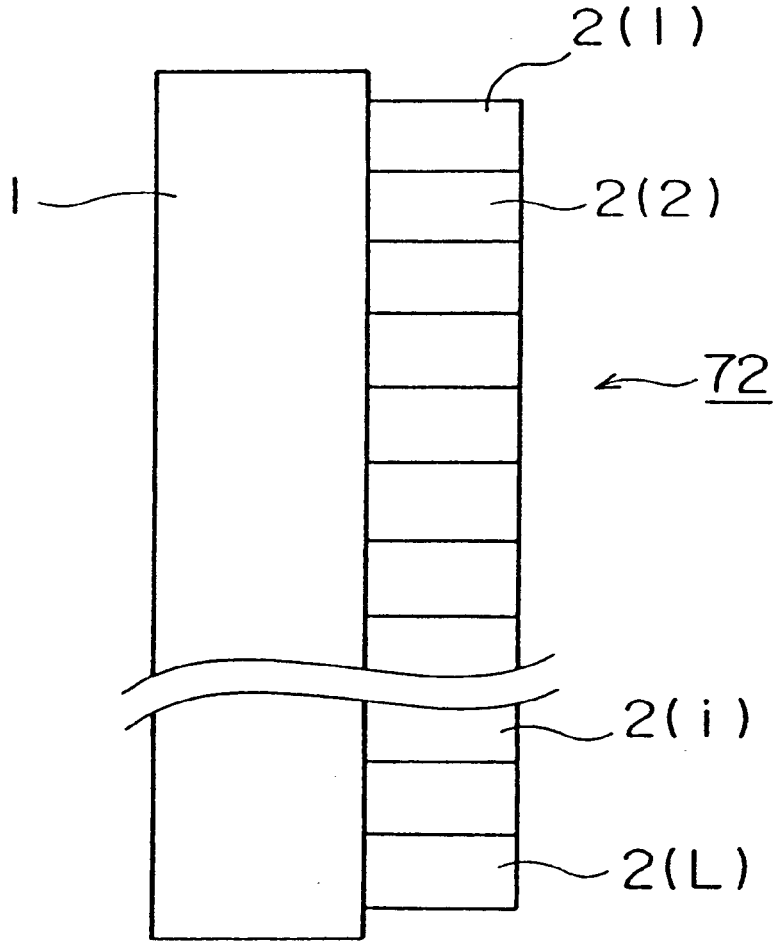
FIG. 4 is a plan view of the ink source.

FIG. 3 is a schematic side view of the ink source 72 noted above. FIG. 4 is a plan view thereof. Ink 3 is omitted from FIG. 4.

The ink source 72 includes an ink fountain roller 1 having an axis thereof extending in a direction of width of printed matter (i.e. perpendicular to a printing direction of the printing apparatus), and ink keys 2 (1), 2 (2) . . . 2 (L)

arranged in the direction of width of the printed matter. In this specification, these ink keys may be collectively called "ink keys 2". The ink keys 2 correspond in number to the number L of areas divided in the direction of width of the printed matter. Each of the ink keys 2 has an adjustable opening degree with respect to the outer periphery of the ink fountain roller 1. The ink fountain roller 1 and ink keys 2 define an ink well for storing ink 3.

Eccentric cams 4, L in number, are arranged under the respective ink keys 2 for pressing the ink keys 2 toward the surface of ink fountain roller 1 to vary the opening degree of each ink key 2 with respect to the ink fountain roller 1. The eccentric cams 4 are connected through shafts 5 to pulse motors 6, L in number, for rotating the eccentric cams 4, respectively.

Each pulse motor 6, in response to an ink key drive pulse applied thereto, rotates the eccentric cam 4 about the shaft 5 to vary a pressure applied to the ink key 2. The opening degree of the ink key 2 with respect to the ink fountain roller 1 is thereby varied to vary the rate of ink fed to the printing plate.

Referring again to FIG. 1, the dampening water feeders 21*a*, 21*b*, 21*c* and 21*d* (which may be referred to collectively as "dampening water feeders 21") feed dampening water to the plates P before the ink feeders 20 feed the inks thereto. Of the dampening water feeders 21, the water feeder 21*a* feeds dampening water to the image area 67*a* on the plate P, the water feeder 21*b* feeds dampening water to the image area 67*b* on the plate P, the water feeder 21*c* feeds dampening water to the image area 67*c* on the plate P, and the water feeder 21*d* feeds dampening water to the image area 67*d* on the plate P.

Figure 5:
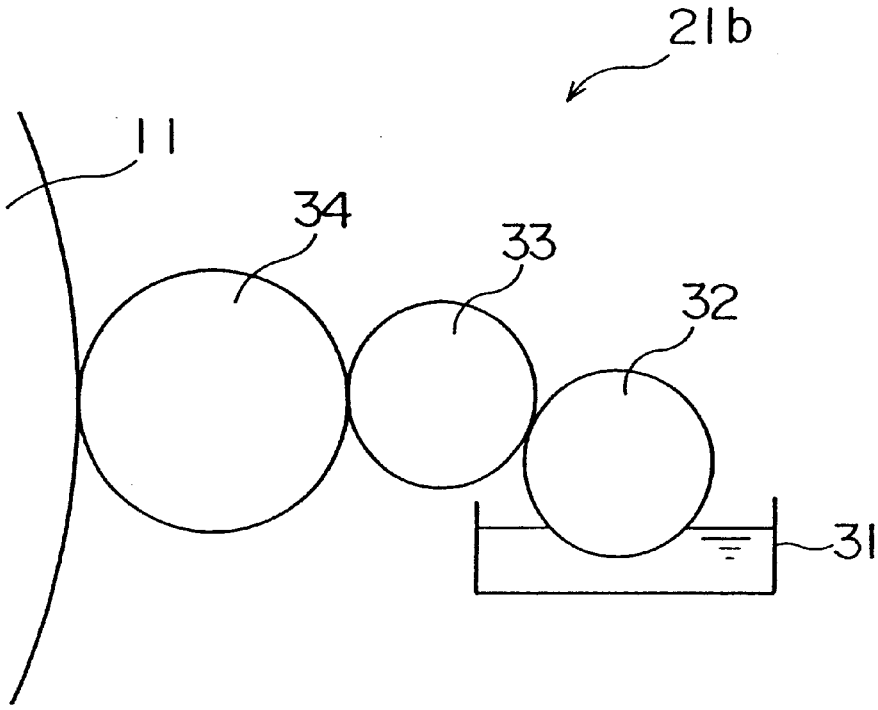
FIG. 5 is a schematic side view of a dampening water feeder.

FIG. 5 is a schematic side view of the dampening water feeder 21*b*.

The dampening water feeder 21*b* includes a water source having a water vessel 31 for storing dampening water and a water fountain roller 32 rotatable by a motor, not shown, and two water rollers 33 and 34 for transferring dampening water from the fountain roller 32 to the surface of the plate mounted peripherally of the first plate cylinder 11. This dampening water feeder is capable of adjusting the rate of feeding dampening water to the surface of the plate by varying the rotating rate of fountain roller 32.

The three other water feeders 21*a*, 21*c* and 21*d* have the same construction as the water feeder 21*b*.

Referring again to FIG. 1, the developing device 26 is disposed under the first plate cylinder 11 or second plate cylinder 12 in the image recording position. This developing device 26 includes a developing unit, a fixing unit and a squeezing unit, which are vertically movable between a standby position shown in two-dot chain lines and a developing position shown in solid lines in FIG. 1.

In developing the images recorded on the plate P by the image recorder 25, the developing unit, fixing unit and squeezing unit are successively brought into contact with the plate P rotated with the first or second plate cylinder 11 or 12.

The first and second blanket cylinders 13 and 14 movable into contact with the first and second plate cylinders 11 and 12 have the same diameter as the first and second plate cylinders 11 and 12, and have ink transfer blankets mounted peripherally thereof. Each of the first and second blanket cylinders 13 and 14 is movable into and out of contact with the first or second plate cylinder 11 or 12 and the impression cylinder 15 by a contact mechanism not shown.

The blanket cleaning unit 29 disposed between the first and second blanket cylinders 13 and 14 cleans the surfaces of the first and second blanket cylinders 13 and 14 by feeding a cleaning solution to an elongate cleaning cloth extending from a delivery roll to a take-up roll through a plurality of pressure rollers, and sliding the cleaning cloth in contact with the first and second blanket cylinders 13 and 14.

The impression cylinder 15 contactable by the first and second blanket cylinders 13 and 14 has half the diameter of the first and second plate cylinders 11 and 12 and the first and second blanket cylinders 13 and 14, as noted hereinbefore. Further, the impression cylinder 15 has a gripper, not shown, for holding and transporting the forward end of printing paper.

The paper feed cylinder 16 disposed adjacent the impression cylinder 15 has the same diameter as the impression cylinder 15. The paper feed cylinder 16 has a gripper, not shown, for holding and transporting the forward end of each sheet of printing paper fed from the paper storage 27 by a reciprocating suction board 74. When the printing paper is transferred from the feed cylinder 16 to the impression cylinder 15, the gripper of the impression cylinder 15 holds the forward end of the printing paper which has been held by the gripper of the feed cylinder 16.

The paper discharge cylinder 17 disposed adjacent the impression cylinder 15 has the same diameter as the impression cylinder 15. The discharge cylinder 17 has a pair of chains 19 wound around opposite ends thereof. The chains 19 are interconnected by coupling members, not shown, having a plurality of grippers 41 arranged thereon. When the impression cylinder 15 transfers the printing paper to the discharge cylinder 17, one of the grippers 41 of the discharge cylinder 17 holds the forward end of the printing paper having been held by the gripper of the impression cylinder 15. With movement of the chains 19, densities of the detecting patches printed on the printing paper are measured at the image pickup station 40. Thereafter the printing paper is transported to the paper discharge station 28 to be discharged thereon.

The paper feed cylinder 16 is connected to a drive motor through a belt not shown. The paper feed cylinder 16, impression cylinder 15, paper discharge cylinder 17 and the first and second blanket cylinders 13 and 14 are coupled to one another by gears mounted on end portions thereof, respectively. Further, the first and second blanket cylinders 13 and 14 are coupled to the first and second plate cylinders 11 and 12 in the first and second printing positions, respectively, by gears mounted on end portions thereof. Thus, a motor, not shown, is operable to rotate the paper feed cylinder 16, impression cylinder 15, paper discharge cylinder 17, the first and second blanket cylinders 13 and 14 and the first and second plate cylinders 11 and 12 synchronously with one another.

Figure 6:
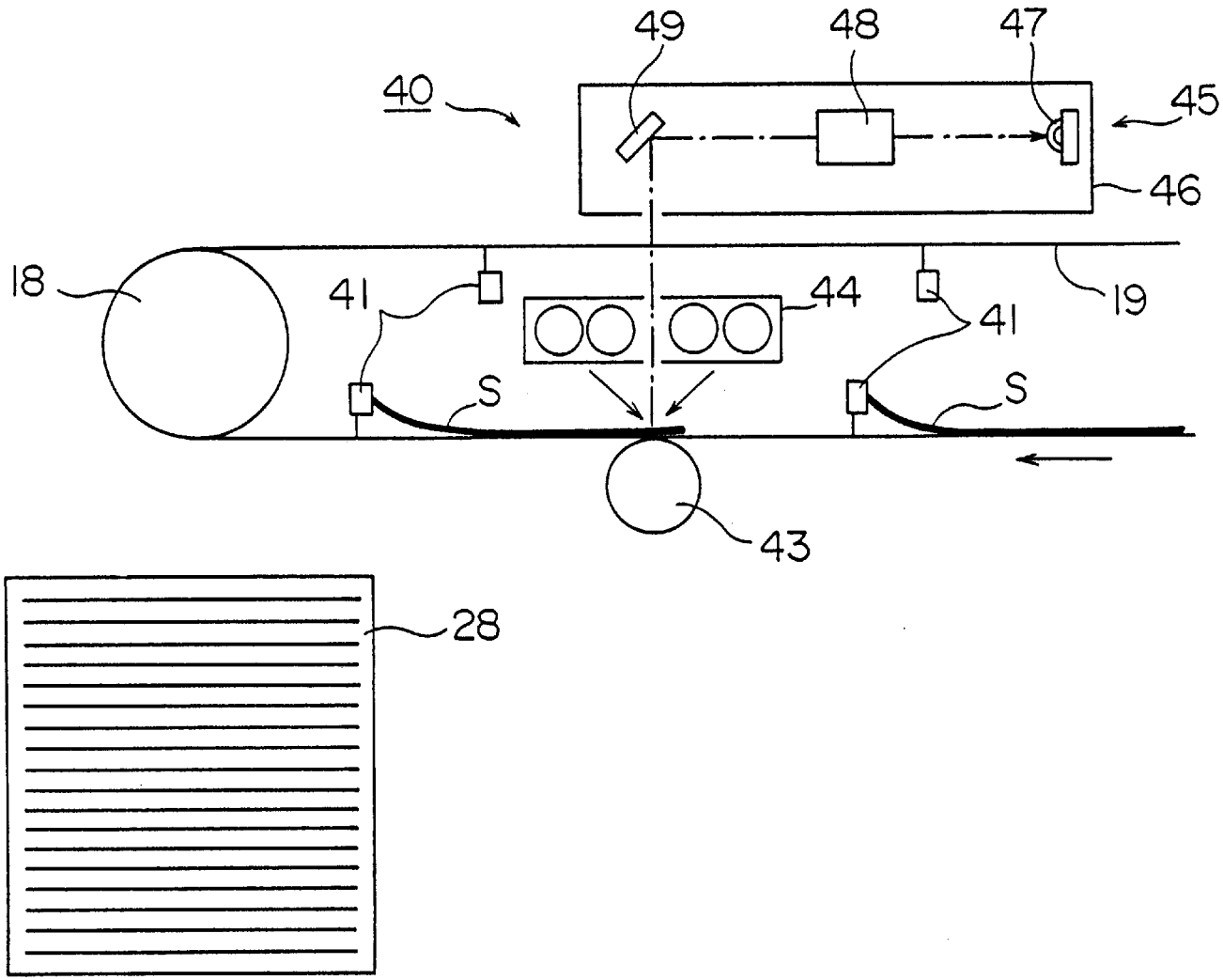
FIG. 6 is a schematic side view of an image pickup station shown with chains.

FIG. 6 is a schematic side view of the image pickup station 40 for measuring densities of the detecting patches printed on the printing paper, which is shown with the chains 19.

The pair of chains 19 are endlessly wound around the opposite ends of the paper discharge cylinder 17 shown in FIG. 1 and a pair of large sprockets 18. As noted hereinbefore, the chains 19 are interconnected by coupling members, not shown, having a plurality of grippers 41 arranged thereon each for gripping a forward end of printing paper S transported.

The pair of chains 19 have a length corresponding to a multiple of the circumference of paper discharge cylinder 17. The grippers 41 are arranged on the chains 19 at intervals each corresponding to the circumference of paper discharge cylinder 17. Each gripper 41 is opened and closed by a cam mechanism, not shown, synchronously with the gripper on the paper discharge cylinder 7. Thus, each gripper 41 receives printing paper S from the paper discharge cylinder 7, transports the printing paper S with rotation of the chains 19, and discharges the paper S to the paper discharge station 28.

The printing paper S is transported with only the forward end thereof held by one of the grippers 41, the rear end of printing paper S not being fixed. Consequently, the printing paper S could flap during transport, which impairs an operation, to be described hereinafter, of the image pickup station 40 to measure densities of the detecting patches. To avoid such an inconvenience, this printing apparatus provides a suction roller 43 disposed upstream of the paper discharge station 28 for stabilizing the printing paper S transported.

The suction roller 43 is in the form of a hollow roller having a surface defining minute suction bores, with the hollow interior thereof connected to a vacuum pump not shown. The suction roller 43 is disposed to have an axis thereof extending parallel to the grippers 41 bridging the pair of chains 19, a top portion of the suction roller 43 being substantially at the same height as a lower run of the chains 19.

The suction roller 43 is driven to rotate or freely rotatable in a matching relationship with a moving speed of the grippers 41. Thus, the printing paper S is drawn to the surface of the suction roller 43, thereby being held against flapping when passing over the suction roller 43. In place of the suction roller 43, a suction plate may be used to suck the printing paper S two-dimensionally.

The image pickup station 40 includes an illuminating unit 44 for illuminating the printing paper S transported, and an image pickup unit 45 for picking up images of the detecting patches on the printing paper S illuminated by the illuminating unit 44 and measuring densities of the patches. The illuminating unit 44 is disposed between the upper and lower runs of chains 19 to extend along the suction roller 43, and has a plurality of linear light sources for illuminating the printing paper S over the suction roller 43.

The image pickup unit 45 includes a light-shielding and dustproof case 46, and a mirror 49, a lens 48 and a CCD line sensor 47 arranged inside the case 46. The image pickup unit 45 picks up the image of printing paper S over the suction roller 43 through slits of the illuminating unit 44. Incident light of the image reflected by the mirror 49 passes through the lens 48 to be received by the CCD line sensor 47.

Figure 7:
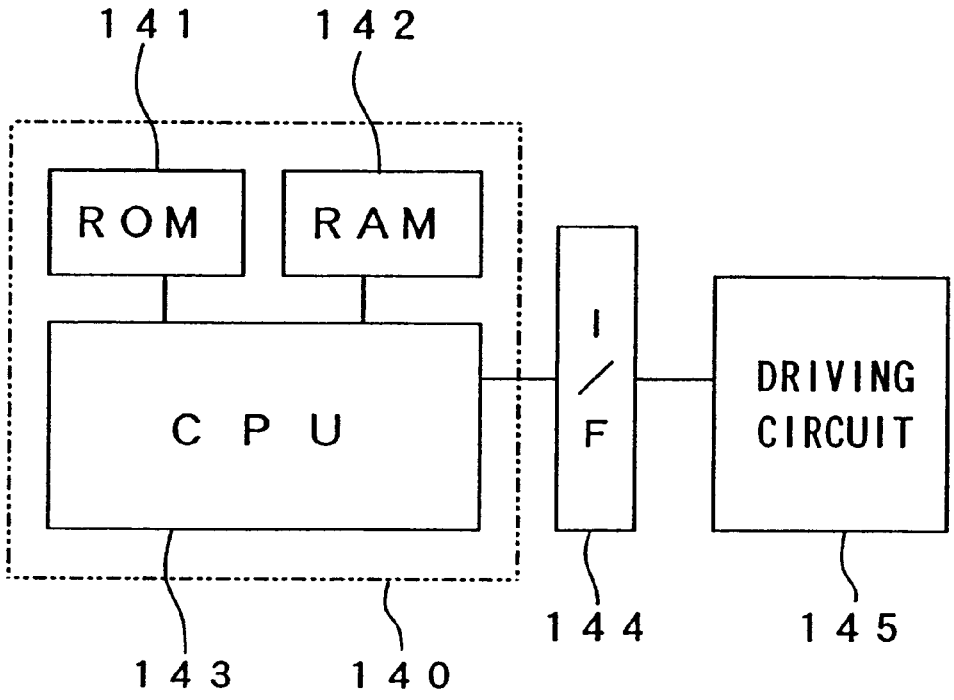
FIG. 7 is a block diagram of a principal electrical structure of the printing apparatus.

FIG. 7 is a block diagram showing a principal electrical structure of the printing apparatus. This printing apparatus includes a control unit 140 having a ROM 141 for storing operating programs necessary for controlling the apparatus, a RAM 142 for temporarily storing data and the like during a control operation, and a CPU 143 for performing logic operations. The control unit 140 has a driving circuit 145 connected thereto through an interface 144, for generating driving signals for driving the ink feeders 20, dampening water feeders 21, image recorder 25, developing device 26, blanket cleaning unit 29, image pickup station 40, the contact mechanisms for the first and second blanket cylinders 13 and 14, and so on. The printing apparatus is controlled by the control unit 140 to execute prepress and printing operations as described hereinafter.

Figure 8:
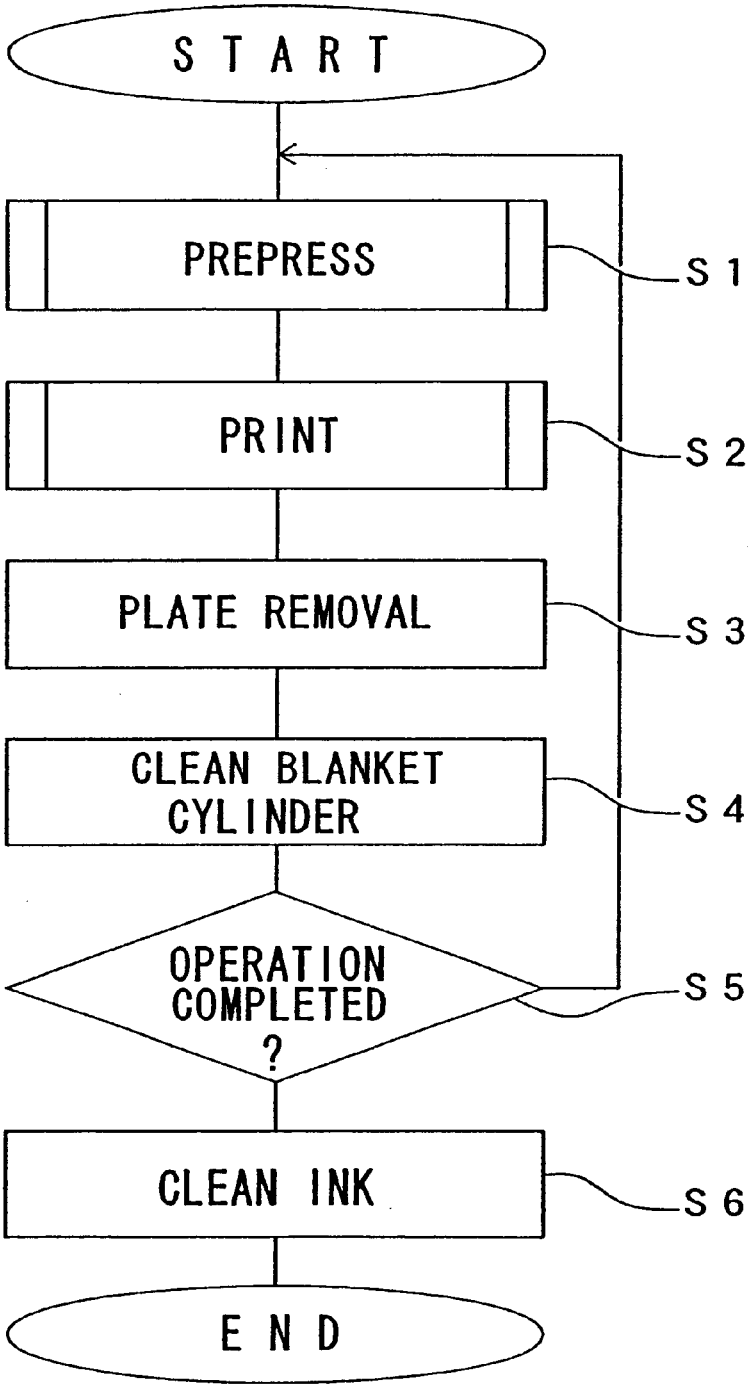
FIG. 8 is a flow chart of prepress and printing operations of the printing apparatus.

The prepress and printing operations of the printing apparatus will be described next. FIG. 8 is a flow chart showing an outline of the prepress and printing operations of the printing apparatus. These prepress and printing operations are directed to multicolor printing of printing paper with the four color inks of yellow, magenta, cyan and black.

Figure 9:
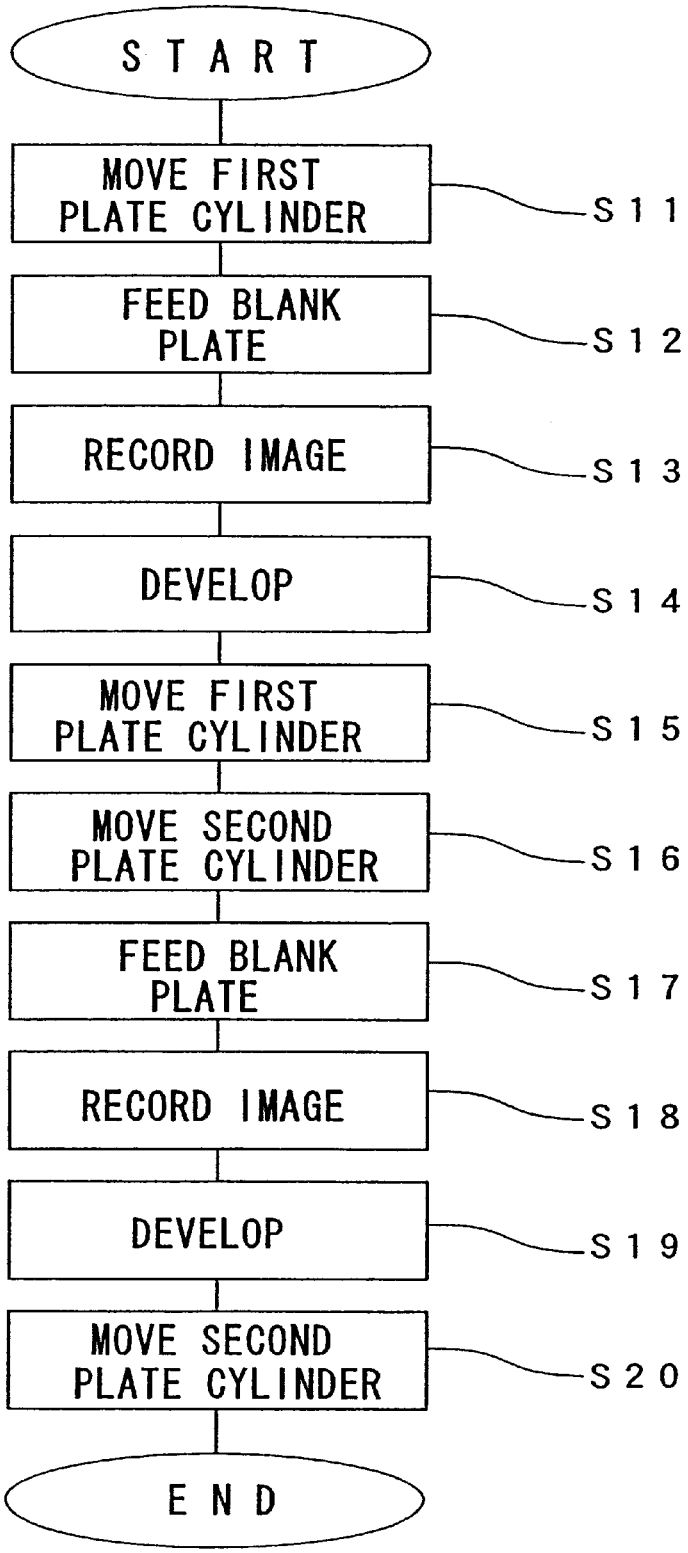
FIG. 9 is a flow chart of a prepress process.

First, the printing apparatus executes a prepress process for recording and developing images on the plates P mounted on the first and second plate cylinders 11 and 12 (step S1). This prepress process follows the steps constituting a subroutine as shown in the flow chart of FIG. 9.

The first plate cylinder 11 is first moved to the image recording position shown in the two-dot chain line in FIG. 1. (step S11).

Next, a plate P is fed to the outer periphery of the first plate cylinder 11 (step S12). To achieve the feeding of the plate P, the pair of grippers, not shown, grip the forward end of plate P drawn from the supply cassette 63, and the rear end of plate P cut by the cutter 66.

Then, an image is recorded on the plate P mounted peripherally of the first plate cylinder 11 (step S13). For recording the image, the image recorder 25 irradiates the plate P mounted peripherally of the first plate cylinder 11 with a modulated laser beam while the first plate cylinder 11 is rotated at low speed.

Next, the image recorded on the plate P is developed (step S14). The developing step is executed by raising the developing device 26 from the standby position shown in two-dot chain lines to the developing position shown in solid lines in FIG. 1 and thereafter successively moving the developing unit, fixing unit and squeezing unit into contact with the plate P rotating with the first plate cylinder 11.

Upon completion of the developing step, the first plate cylinder 11 is moved to the first printing position shown in the solid line in FIG. 1 (step S15).

Subsequently, the printing apparatus carries out an operation similar to steps S11 to S15 by way of a prepress process for the plate P mounted peripherally of the second plate cylinder 12 (steps S16 to S20). Completion of the prepress steps for the plates P mounted peripherally of the first and second plate cylinders 11 and 12 brings the prepress process to an end.

Referring again to FIG. 8, the prepress process is followed by a printing process for printing the printing paper with the plates P mounted on the first and second plate cylinders 11 and 12 (step S2). This printing process is carried out as follows.

First, each dampening water feeder 21 and each ink feeder 20 are placed in contact with only a corresponding one of the image areas on the plates P mounted on the first and second plate cylinders 11 and 12. Consequently, dampening water and inks are fed to the image areas 67*a*, 67*b*, 67*c* and 67*d* from the corresponding water feeders 21 and ink feeders 20, respectively. These inks are transferred from the plates P to the corresponding regions of the first and second blanket cylinders 13 and 14, respectively.

Then, the printing paper S is fed to the paper feed cylinder 16. The printing paper S is subsequently passed from the paper feed cylinder 16 to the impression cylinder 15. The impression cylinder 15 continues to rotate in this state. Since the impression cylinder 15 has half the diameter of the first and second plate cylinders 11 and 12 and the first and second blanket cylinders 13 and 14, the black and cyan inks are transferred to the printing paper wrapped around the impression cylinder 15 in its first rotation, and the magenta and yellow inks in its second rotation.

The forward end of the printing paper printed in the four colors is passed from the impression cylinder 15 to the paper discharge cylinder 17. This printing paper is transported by the pair of chains 19 toward the paper discharge station 28. After the densities of the detecting patches are measured at the image pickup station 40, the printing paper is discharged to the paper discharge station 28.

Upon completion of the printing process, the plates P used in the printing are removed (step S3). To remove the plates P, the first plate cylinder 11 is first moved to the image recording position shown in the two-dot chain line in FIG. 1. Then, while the first plate cylinder 11 is rotated counterclockwise, the pawl mechanism 73 separates an end of the plate P from the first plate cylinder 11. The plate P separated is guided by the conveyor mechanism 69 into the discharge cassette 68. After returning the first plate cylinder 11 to the first printing position, the second plate cylinder 12 is moved from the second printing position to the image recording position to undergo an operation similar to the above, thereby having the plate P removed from the second plate cylinder 12 for discharge into the discharge cassette 68.

Upon completion of the plate removing step, the first and second blanket cylinders 13 and 14 are cleaned by the blanket cleaning unit 29 (step S4).

After completing the cleaning of the first and second blanket cylinders 13 and 14, the printing apparatus determines whether or not a further image is to be printed (step S5). If a further printing operation is required, the apparatus repeats steps S1 to S4.

If the printing operation is ended, the printing apparatus cleans the inks (step S6). For cleaning the inks, an ink cleaning device, not shown, provided for each ink feeder 20 removes the ink adhering to the ink rollers 71 and ink source 72 of each ink feeder 20.

With completion of the ink cleaning step, the printing apparatus ends the entire process.

The printing apparatus having the above construction uses detecting patches also known as control scales to control the rates of feeding ink and dampening water to the printing plates P.

Figure 10:
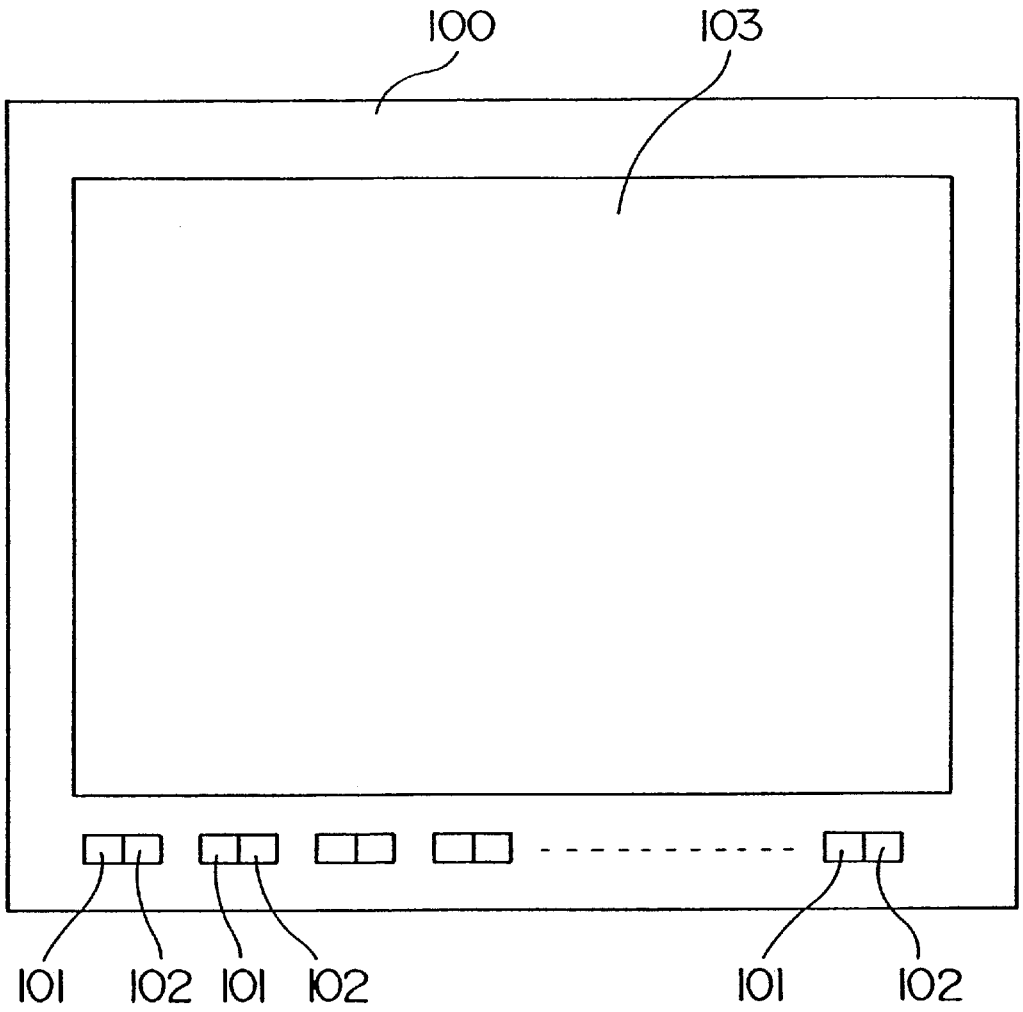
FIG. 10 is an explanatory view of first detecting patches and second detecting patches.

FIG. 10 is an explanatory view showing first detecting patches 101 and second detecting patches 102 printed on printing paper 100 after a printing process.

These first and second detecting patches 101 and 102 are printed in areas between one end of the printing paper 100 and an end of an image area 103 on the printing paper 100. The first detecting patches 101 and second detecting patches 102 are arranged in discrete, adjacent pairs, L in number corresponding to the number L of areas divided in the direction of width of the printed matter (i.e. perpendicular to the printing direction of the printing apparatus), as are the ink keys 2 noted above.

As the first and second detecting patches 101 and 102, such materials are used that show different density variations, after printing, with variations in the feed rates of dampening water and ink. The material used for the first detecting patches 101 has a large halftone area ratio, while the material used for the second detecting patches 102 has a small halftone area ratio.

Figure 11:
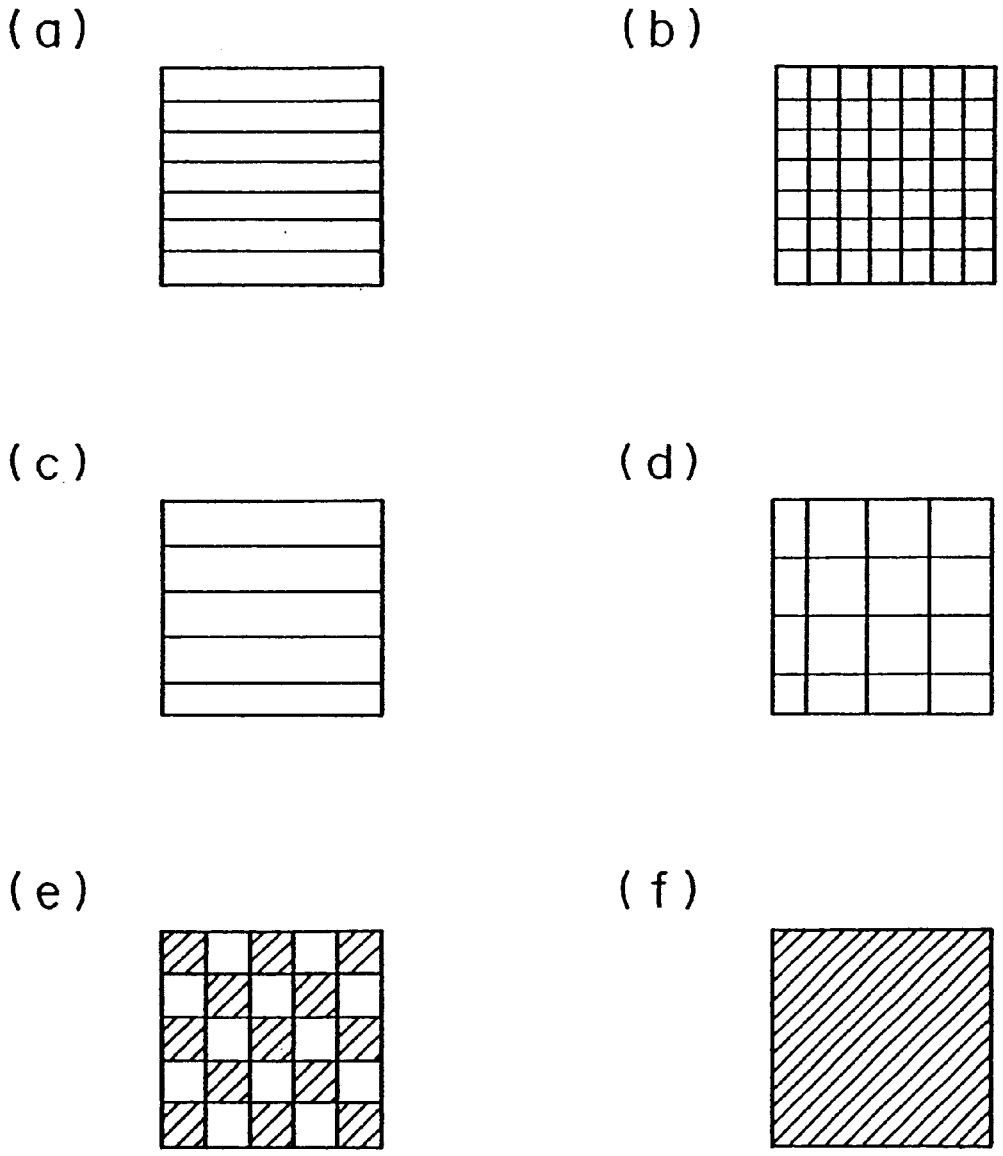
FIG. 11 is an explanatory view schematically showing various detecting patches.

FIG. 11 is an explanatory view schematically showing various detecting patches usable as the first and second detecting patches 101 and 102.

In FIG. 11, (a) is a patch having horizontal lines at intervals of 50 $\mu$m, (b) is a patch having a combination of horizontal lines at intervals of 50 $\mu$m, and vertical lines at intervals of 50 $\mu$m, (c) is a patch having horizontal lines at intervals of 100 $\mu$m, (d) is a patch having a combination of horizontal lines at intervals of 100 $\mu$m, and vertical lines at intervals of 100 $\mu$m, (e) is a halftone patch having a halftone area ratio at 50%, and (f) is a solid patch having a halftone area ratio at 100%.

Preferably, the solid patch shown in FIG. 11(*f*) is used as the first detecting patches 101. However, a patch having a halftone area rate close to 100% may be used. It is also possible to use the halftone patch having a halftone area ratio of 50% shown in FIG. 11(*e*), or a patch having lines at relatively small intervals. As the second detecting patches 102, the patches having lines as shown in FIGS. (a)–(d) may be used. It is also possible to use patches having relatively small halftone area ratios. The "detecting patches having large halftone area ratios" and "detecting patches having small halftone area ratios" used herein represent a concept embracing the solid and line patches described above.

Next, an operation for controlling the rates of feeding ink and dampening water to the printing plates P by using the first and second detecting patches 101 and 102 will be described.

This control operation starts with a preliminary printing step in which printing is performed a plurality of times while varying the feed rates of ink and dampening water. This step is executed to determine, by multiple linear regression, an equation expressing a parameter Dwx corresponding to density variations of the first and second detecting patches 101 and 102 occurring with variations in the feed rate of dampening water. Next, a parameter Dwx is computed by substituting into the above equation a density D1*x* of the first detecting patches 101 and a density D2*x* of the second detecting patches 102 on printed matter obtained from trial printing. An adjusted ink feed rate $\alpha$ is computed by using this parameter Dwx. The feed rates of dampening water and ink are adjusted based on the parameter Dwx and the adjusted ink feed rate a computed, respectively.

That is, printing is first carried out a plurality of times while varying the feed rate of dampening water. A critical density DM at which a defective print is caused by a shortage of dampening water is determined from the first detecting patches 101 on the printed matter obtained from this printing. This critical density DM is a density at which ink smudging occurs in the areas of the first detecting patches 101. It will be appreciated that the feed rate of dampening water may be varied simply by varying the rotating rate of the water fountain roller 32 shown in FIG. 5.

The above parameter Dwx is a parameter relating to density variations of the first and second detecting patches 101 and 102 occurring with variations in the feed rate of dampening water. In this embodiment, the parameter Dwx is computed from a predetermined equation based on measured density values of the detecting patches. That is, in this embodiment, the parameter Dwx is obtained by substituting measured densities D1*x* and D2*x* of the first and second detecting patches (densities of first, second and third detecting patches where three types of patches are used) into a predetermined computational expression such as an equation (1) to be described hereinafter.

Next, printing is carried out a plurality of times while varying the feed rate of ink. A density D1*x* of the first detecting patches 101 and a density D2*x* of the second detecting patches 102 in time of each printing are determined from the printed matter obtained from the above printing. The feed rate of ink may be varied by varying, en bloc, the opening degree of the ink keys 2, L in number, with respect to the ink fountain roller 1 shown in FIG. 4. At this time, the feed rate of dampening water should be maintained at a proper rate for printing which is higher than the above-noted water feed rate for causing a defective print due to a shortage of dampening water.

Next, values of coefficients a, b and c are derived from the following equation (1) representing parameter Dwx, by multiple linear regression, using the critical density DM measured previously, and density D1*x* of the first detecting patches 101 and density D2$x$ of the second detecting patches 102 in time of each printing:

$$Dwx=DM-D1x=a\cdot D1x+b\cdot D2x+c \quad (1)$$

Figure 12:
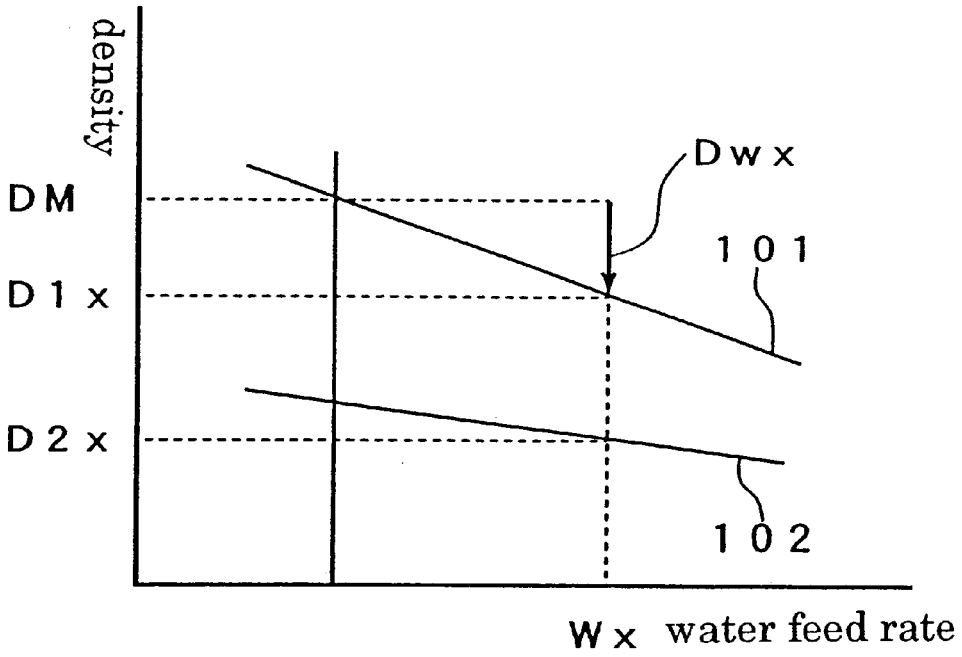
FIG. 12 is an explanatory view showing a relationship between dampening water feed rate and density for the first detecting patches and second detecting patches, respectively.

FIG. 12 is an explanatory view showing a relationship between dampening water feed rate and density for the first detecting patches 101 and second detecting patches 102, respectively.

In this figure, the density of the first detecting patches 101 is D1$x$ when the dampening water feed rate is Wx, the density of the second detecting patches 102 is D2$x$ when the dampening water feed rate is Wx, and the density of the first detecting patches 101 is DM when a defective print is caused by a shortage of dampening water. The parameter Dwx, or DM−D1$x$, corresponding to density variations of the first and second detecting patches 101 and 102 occurring with variations in the dampening water feed rate is expressed by the above equation (1).

For this equation (1), as noted hereinbefore, values of coefficients a, b and c are determined by multiple linear regression, using the critical density DM, and a plurality of densities D1$x$ of the first detecting patches 101 and a plurality of densities D2$x$ of the second detecting patches 102 measured by carrying out printing a plurality of times while varying the feed rate of ink.

Upon completion of the above preliminary printing step, a trial printing is carried out before starting an actual production printing. From the printed matter obtained through the trial printing, a density D1$x$ of the detecting patch 101 and a density D2$x$ of the second detecting patch 102 are measured for each of the L areas divided in the direction of width of the printed matter.

Then, parameter Dwx is computed for each of the L areas by substituting, into equation (1), the density D1$x$ of the detecting patch 101 and the density D2$x$ of the second detecting patch 102 in each area, and the coefficients a, b and c obtained by multiple linear regression.

The parameter Dwx for each of the L areas shows a difference from an optimal dampening water feed rate for each such area. It is therefore preferable to change dampening water feed rate based on this parameter. However, in the actual printing apparatus, though ink is adjustable for each of the L areas, dampening water is difficult to adjust for each such area. Thus, ink clogging is prevented by adjusting the dampening water feed rate based on a minimum parameter minDwx of the L parameters.

That is, the dampening water feed rate is changed by multiplying the minimum parameter minDwx of the parameters Dwx for each of the L areas by a predetermined coefficient. More particularly, the dampening water feed rate may be controlled to be a proper rate by adjusting the rotating rate of the water fountain roller 32 based on the following equation:

$$Rn+1=Rn-Kw\cdot minDwx$$

where Rn is a current rotating rate of the water fountain roller 32, Rn+1 is an adjusted rotating rate of the fountain roller 32, and Kw is a loop gain (coefficient) of the dampening water feeder 21.

A value slightly smaller than minDwx may be used in order to avoid ink clogging due to an overshoot or computing error occurring when controlling the damping water feed rate.

After computing the damping water feed rate as described above, an ink feed rate is computed for each of the L areas by taking the damping water feed rate into account.

Figure 13:
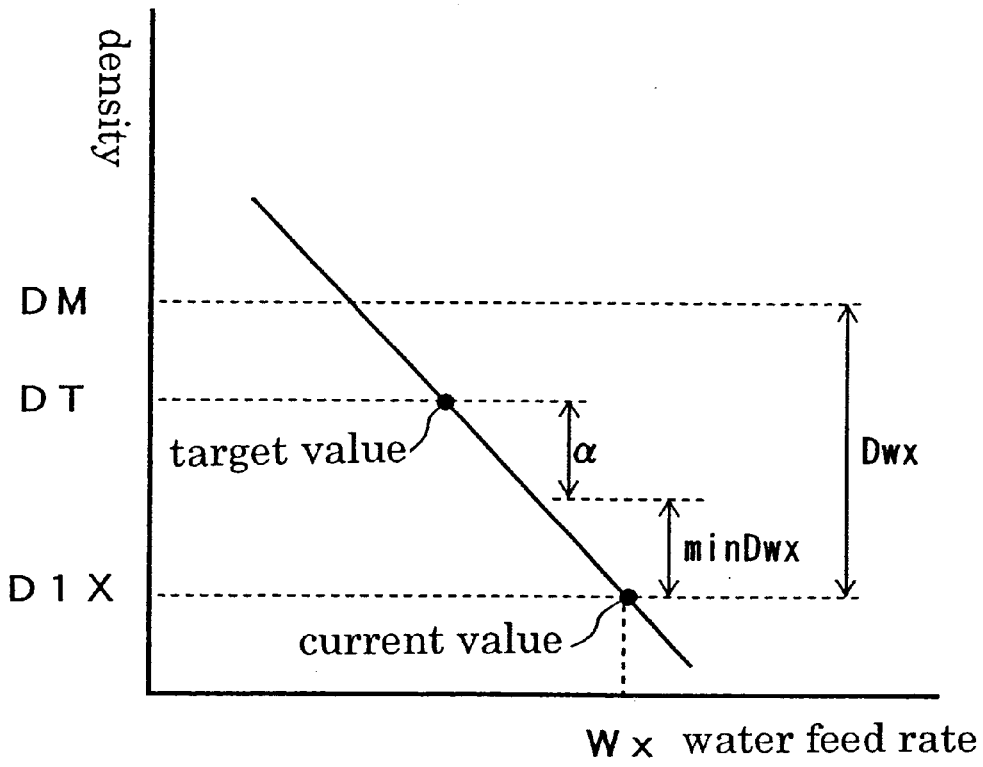
FIG. 13 is an explanatory view showing a relationship between dampening water feed rate and density for the first detecting patches.

FIG. 13 is an explanatory view showing a relationship between dampening water feed rate and density for the first detecting patches 101.

Specifically, the ink feed rate must be adjusted to bring current density DX1 of first detecting patches into agreement with a target density DT. However, since the dampening water feed rate is adjusted by a quantity corresponding to the parameter minDwx beforehand, the ink feed rate may be adjusted only by a quantity indicated by α in FIG. 13. That is, considering that the feed rate of dampening water is adjusted based on the minimum parameter minDwx of the L parameters, a density difference α in FIG. 13 is expressed by the following equation (2):

$$\alpha=DT-DM+(Dwx-\min Dwx) \quad (2)$$

where DT is the target density of the first detecting patches 101.

Thus, the density difference α may be determined by substituting into the equation (2) the target density DT, the critical density DM obtained previously, the parameter Dwx of each of the L areas, and the minimum parameter minDwx of the parameters Dwx of the L areas. DM−D1$x$ may be used instead of Dwx.

As the target density DT, for example, 1.3 may be used for yellow ink, 1.4 for magenta ink, 1.5 for cyan ink, and 1.8 for black ink.

The density difference a for each of the L areas obtained by the above computation is a density conversion value. By multiplying this by a loop gain Ki of the ink feeder 20, this value is converted to an opening degree of each ink key 2 with respect to the ink fountain roller 1. More particularly, the ink feed rate may be controlled to be a proper rate for each of the L areas by adjusting the opening degree of each ink key 2 based on the following equation:

$$Kn+1=Kn+Ki\cdot\alpha$$

where Kn is a current opening degree of each ink key 2, and Kn+1 is an adjusted opening degree of each ink key 2.

Upon completion of all of the above steps, an actual production printing may be carried out with the ink feed rate and dampening water feed rate controlled by using Rn+1 and Kn+1 obtained from the above steps. This enables a proper printing to be carried out automatically.

In the above embodiment, the feed rates of dampening water and ink are controlled by using the first and second detecting patches 101 and 102. The feed rates of dampening water and ink may be controlled by using three types of, i.e. first, second and third, detecting patches.

In this case, the solid patch shown in FIG. 11(*f*) should preferably be used as the first detecting patches as in the case of the first detecting patches 101 described above. However, a halftone patch having a halftone area ratio close to 100% may be used instead.

As the second and third detecting patches, the line patches shown in FIGS. 11(*a*)–(*d*) may be used as in the case of the above second detecting patches 102. However, where the patch, shown in FIG. 11(*a*), having horizontal lines at intervals of 50 μm, or the patch, shown in FIG. 11(*b*), having a combination of horizontal lines at intervals of 50 μm, and vertical lines at intervals of 50 μm, is used as the second detecting patches, the third detecting patches should have a different resolution to the second detecting patches and, therefore, the patch, shown in FIG. 11(*c*), having horizontal lines at intervals of 100 μm, or the patch, shown in FIG. 11(*d*), having a combination of horizontal lines at intervals of 100 μm, and vertical lines at intervals of 100 μm, is used.

In this case, the following equation (3) is used instead of the foregoing equation (1):

$$Dwx=DM-D1x=d\cdot D1x+e\cdot D2x+f\cdot D3x+g \quad (3)$$

where D1$x$ is a density of the first detecting patches, D2$x$ is a density of the second detecting patches, D3$x$ is a density of the third detecting patches, and d, e, f and g are coefficients.

In the above embodiment, the densities of the first and second detecting patches 101 and 102 are measured by using the image pickup station 40 included in the printing apparatus, and various computations are performed by the control unit 140 of the printing apparatus. However, a dampening water and ink feed rate control device may be provided separately from the printing apparatus for performing the density measurement and computations, results of the computations being used by the printing apparatus in adjusting the feed rates of dampening water and ink.

[Second Embodiment]

The second embodiment of this invention will be described next.

In the first embodiment described above, coefficients a, b, c and so on in the equation (1) are obtained beforehand by using multiple linear regression. In the second embodiment, a parameter Dwn may be computed directly by using other computational expressions. The parameter Dwn described hereinafter corresponds to the parameter Dwx described hereinbefore, but is different in the range of numerical values.

Regarding the density of printed matter, Yule-Nielsen's equation (4) set out below is known as an equation for estimating a reflection density of a halftone print including the effect of a dot gain in printing:

$$Dm=-N\cdot Log\{1-K(1-10^{(-Ds/N)})\} \quad (4)$$

where Ds is a reflection density of printed matter with first patches having a halftone area ratio at 100%, Dm is a reflection density of printed matter with second patches having a halftone area ratio at K×100% (K being a coefficient larger than 0 and smaller than 1), and N is a coefficient.

Generally, the coefficient N is known to be variable with the type of paper and the number of lines as disclosed, for example, in a lecture entitled "Measurement of Point Spread Function of Printing Paper and Analysis of Optical Dot Gain" (Mitsubishi Paper Mills Ltd. and The University of Chiba) given at the 102nd spring meeting for reading research papers of the Japanese Society of Printing Science and Technology, 1999. Further, it has been found through research made by Applicants that the coefficient N may be used for inferring a feed rate of dampening water by fixing the type of paper and the number of lines on detecting patches used in measurement.

Yule-Nielsen's equation cannot provide an analytical solution for coefficient N. Thus, a convergent calculation of coefficient N has been carried out based on measured reflection densities Ds and Dm by using Newton's method which is a generally known calculation technique. The method of calculating coefficient N will be described hereinafter.

Figure 14:
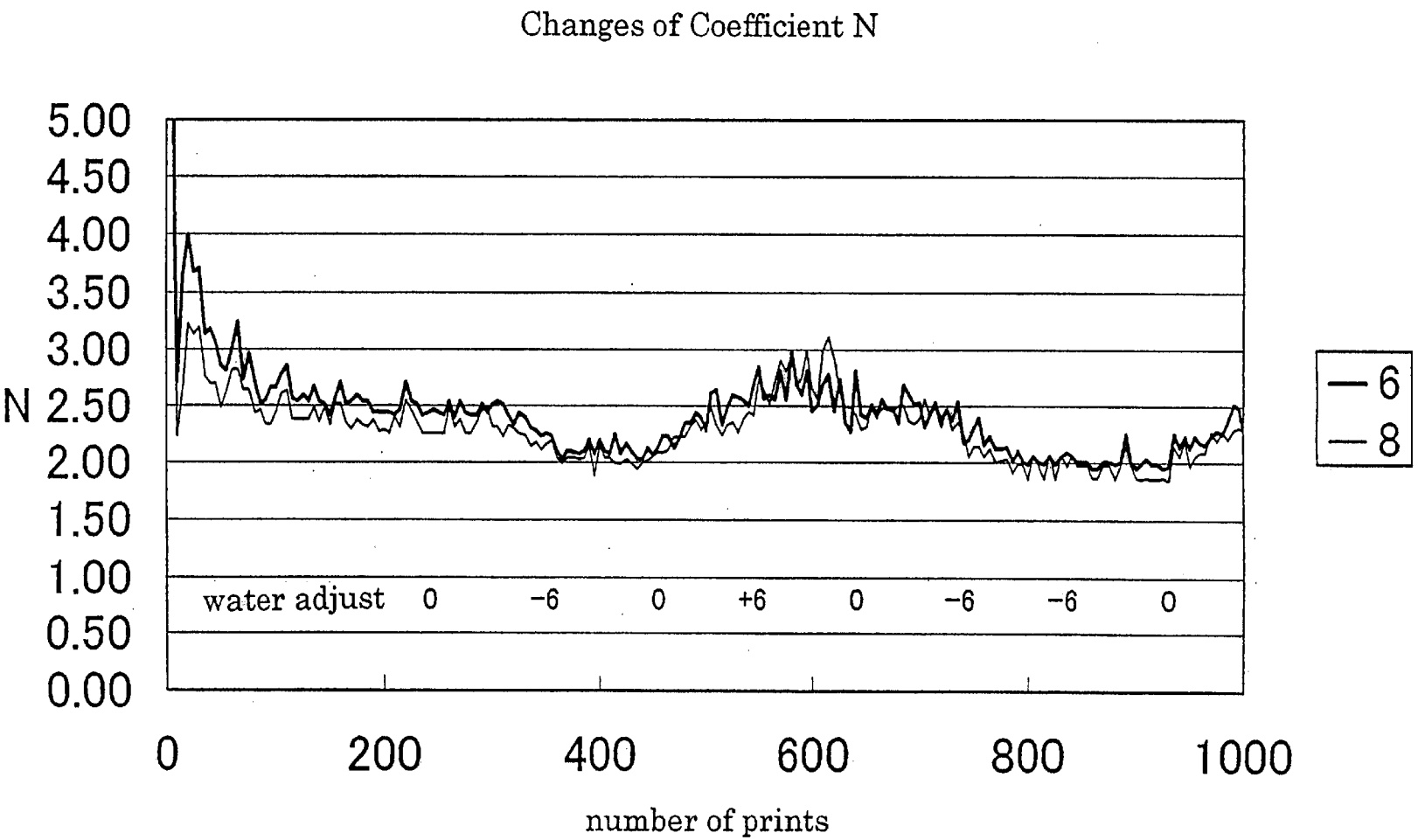
FIG. 14 is a graph showing changes of coefficient N occurring with variations in the feed rate of dampening water.

FIG. 14 is a graph showing coefficient N obtained by the convergent calculation plotted for different numbers of prints. In the second embodiment, the number L of ink keys 2 is 12, but FIG. 14 plots only for the sixth and eighth keys 2(6) and 2(8) to avoid complexity.

FIG. 14 shows coefficient N in time series with the horizontal axis representing the number of prints. During this printing operation, the feed rate of dampening water is raised and lowered from a proper rate, and measurement is made to determine how coefficient N changes. FIG. 14 includes a column showing "water adjust", "−6" and "+6". These values indicate points of time at which the water feed rate is lowered and raised by 6% from the proper rate, respectively.

As seen from FIG. 14, coefficient N varies with the feed rate of dampening water. At the proper feed rate, coefficient N is found to be a substantially fixed value (around 2.50). Thus, the feed rate of dampening water may be controlled properly by adjusting the feed rate so that coefficient N be a proper value set beforehand. However, coefficient N is greatly variable in response to the feed rate of dampening water due to the dot gain effect. It is therefore preferable to control the parameter Dwn described hereinafter rather than directly controlling the above coefficient N.

This parameter Dwn will be described hereinafter. First, Yule-Nielsen's equation may be transformed as follows:

$$K=(1-10^{(-Dm/N)})/(1-10^{(-Ds/N)})$$

K is fixed to 0.5 where the second detecting patches used here have a halftone area ratio at 50%. Where the halftone area ratio is fixed, the reflection densities Ds and Dm never vary extensively, and therefore values of the numerator and denominator in the above equation are variable within a fixed range. Particularly, results of computations carried out by Applicants have shown that the denominator in the above equation changes more effectively in response to the feed rate of dampening water. Thus, the parameter Dwn is defined here by using the denominator portion of the above equation.

$$Dwn=1/(1-10^{(-Ds/N)}) \quad (5)$$

Figure 15:
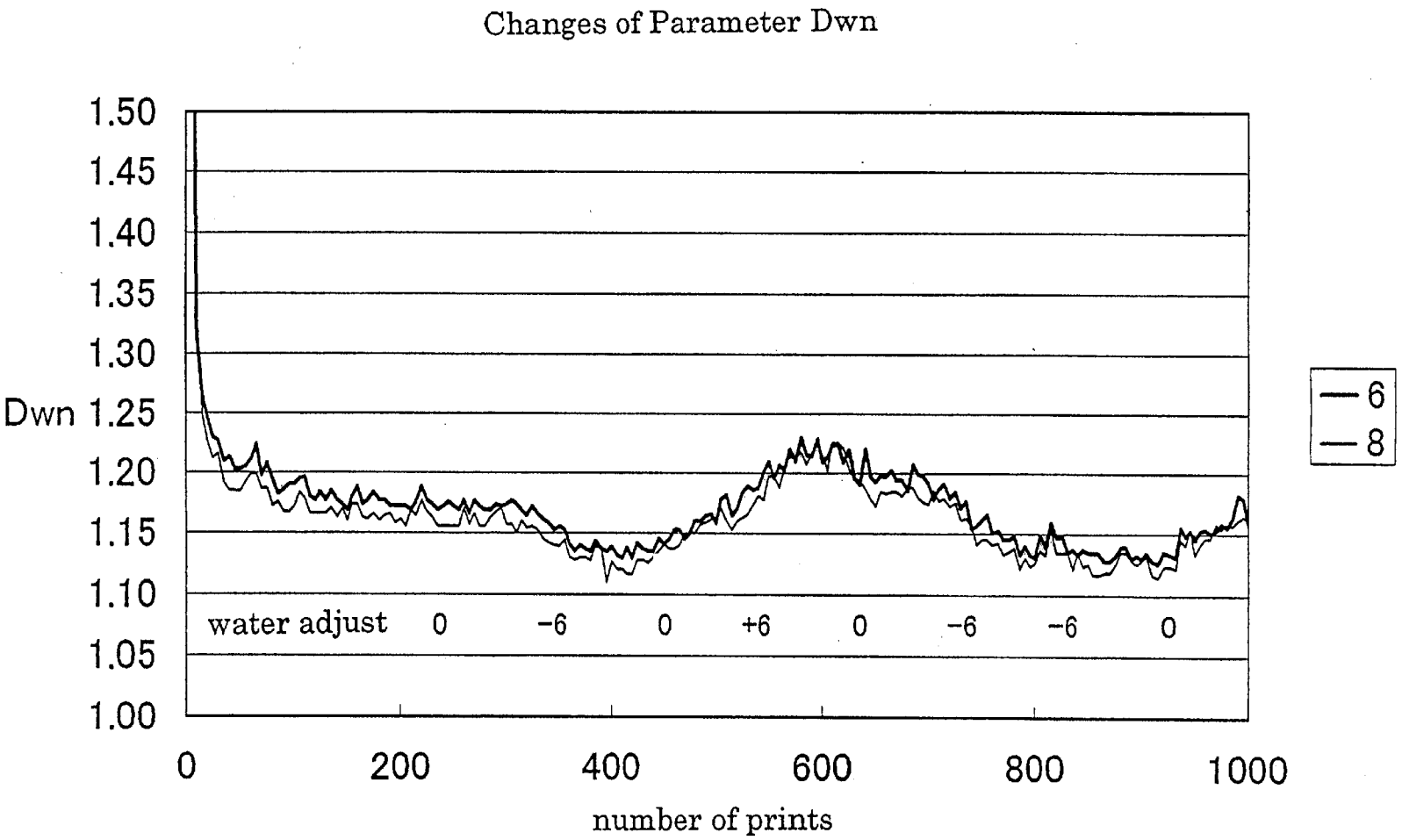
FIG. 15 is a graph showing changes of parameter Dwn occurring with variations in the feed rate of dampening water.

FIG. 15 shows changes of parameter Dwn. As seen, where this parameter Dwn is used, variations in the feed rate of dampening water can be detected to be greater than those of coefficient N. Though somewhat depending on the type and characteristic of ink, parameter Dwn has an advantage over coefficient N in that results of the computation may be obtained in a form near what is called normalized form, whereby a proper water feed rate is in the order of Dwn=1.2. In results of experimentation carried out by Applicants, the proper water feed rate is obtained when parameter Dwn is in the order of 1.2; an excessive water feed when parameter Dwn is greater than 1.3, and a shortage of water when parameter Dwn is smaller than 1.1.

In the above description, the parameter Dwn is expressed by the computational expression using, as variables, the reflection density Ds of the first detecting patches and the coefficient N. This computational expression for the parameter Dwn is given only by way of example, and may take other forms. In the simplest form, Dwn may be assumed equal to N since coefficient N alone could produce an effect of control though extensively variable.

Assuming a predetermined computational expression with function F(i) having i as a variable, Dwn may take the form of function Dwn=F(N) having N as a variable, function Dwn=F(N, Ds) having N and Ds as variables, or function Dwn=F(N, Dm) having N and Dm as variables. A change in the computational expression will of course results in a change in the range of numerical values of the proper feed rate of dampening water noted above. The line patches used in the above embodiment may be replaced with halftone patches.

In the method of feeding dampening water in the second embodiment, the reflection density Ds of the first detecting patches (solid patches or substantially 100% area ratio patches) and the reflection density Dm of the second detecting patches (patches having a halftone area ratio at K×100%, for example K is 0.5 or the like) are measured first. Then, coefficient N is derived from the above values based on Yule-Nielsen's equation. Parameter Dwn is derived from this coefficient N (or based on variable N and measured density Ds or Dm). The feed rate of dampening water is adjusted to maintain the parameter Dwn at a predetermined value.

Next, the method of computing the above coefficient N will be described. In the second embodiment, coefficient N is derived from Yule-Nielsen's equation. However, as noted hereinbefore, this equation cannot provide an analytical solution for coefficient N. In the second embodiment, therefore, a value of coefficient N is obtained by a convergent calculation. Where an actual measurement control is effected in real time, it is preferable to carry out an alternative calculation by the following approximate expression (6):

$$Dm=-N\cdot Log\{1-K(1-10^{(-Ds)})\} \quad (6)$$

This expression (6) may be transformed into the following equation:

$$N=-Dm/Log\{1-K(1-10^{(-Ds)})\}$$

The above equation is only one example of approximate expression, and other forms of approximate expression may be used. It is possible to expedite the computation by using such an approximate expression.

[Third Embodiment]

The ink source 72 has ink keys 2 corresponding to the plurality of areas, and it is preferable to control the parameter Dwn for these areas individually. Generally, however, a dampening water feed mechanism is not constructed to be variable for each area as is an ink feed mechanism. The third embodiment concerns a procedure for adjusting dampening water for the plurality of areas arranged in the direction of printing width as described hereinafter.

Figure 16:
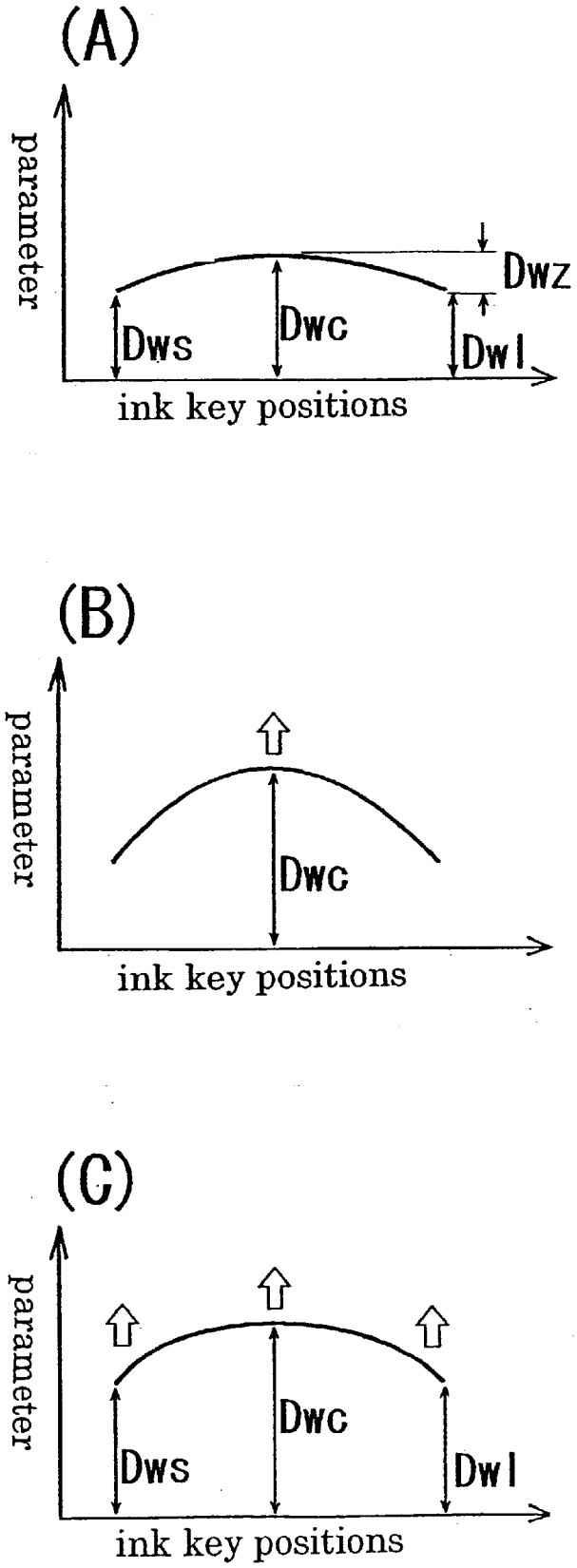
FIG. 16 is an explanatory view showing changes in a distribution of dampening water in a direction of printing width occurring with variations in the feed rate of dampening water.

Generally, when the feed rate of dampening water is raised from a proper rate, the quantity of water initially increases in areas substantially in the middle in the direction of printing width. With a further increase in the feed rate, the quantity of water increases as a whole. FIG. 16 is an explanatory view showing variations of parameter Dwn in the direction of printing width occurring in the above instance. In FIG. 16, the horizontal axis represents positions of the ink keys, and the vertical axis represents the parameter.

In general, when dampening water is fed at a proper rate, parameters are distributed in an arcuate form with a raised middle as shown in FIG. 16(A). It is assumed here that the parameter in the middle is Dwc while the parameters at the opposite ends are Dws and Dwl. When the feed rate of dampening water is raised from this state, the parameter Dwc in the middle increases as shown in FIG. 16 (B). With a further increase in the feed rate, the parameters Dws, Dwc and Dwl all increase to higher levels as shown in FIG. 16(C). With this behavior, whether the feed rate of dampening water is proper or not may be determined from the value of parameter Dwc for the middle and a difference Dwz between the value of parameter Dwc and the value of parameters Dws and Dwl at the opposite ends. A specific computational procedure will be described hereinafter.

In this embodiment, as noted hereinbefore, the number L of ink keys 2 shown in FIG. 4 is 12. The computation is carried out by using reflection densities Ds1–Ds12 and Dm1–Dm12 measured for the respective keys 2. Ds1–Ds12 are reflection densities obtained by measuring the first detecting patches (solid patches) for the first to 12th keys 2. Dm1–Dm12 are reflection densities obtained by measuring the second detecting patches (patches with a halftone area ratio at K×100%) for the first to 12th keys 2.

First, parameters Dwn1–Dwn12 are computed for the respective areas. This computation is carried out as described in the second embodiment. Next, parameter Dwc is obtained by averaging parameters for the keys 2 in middle areas, and parameters Dws and Dwl by averaging parameters for the keys 2 in opposite end areas. In this instance, each of the parameters Dwc, Dws and Dwl is determined by taking an average of two areas as described hereinafter. However, the number of areas adopted for the averaging is not limited to two; one area may be used for each parameter, or three or more areas may be used to obtain each parameter.

$$Dwc=(Dwn6+Dwn7)/2$$

$$Dws=(Dwn1+Dwn2)/2$$

$$Dwl=(Dwn11+Dwn12)/2$$

Figure 17:
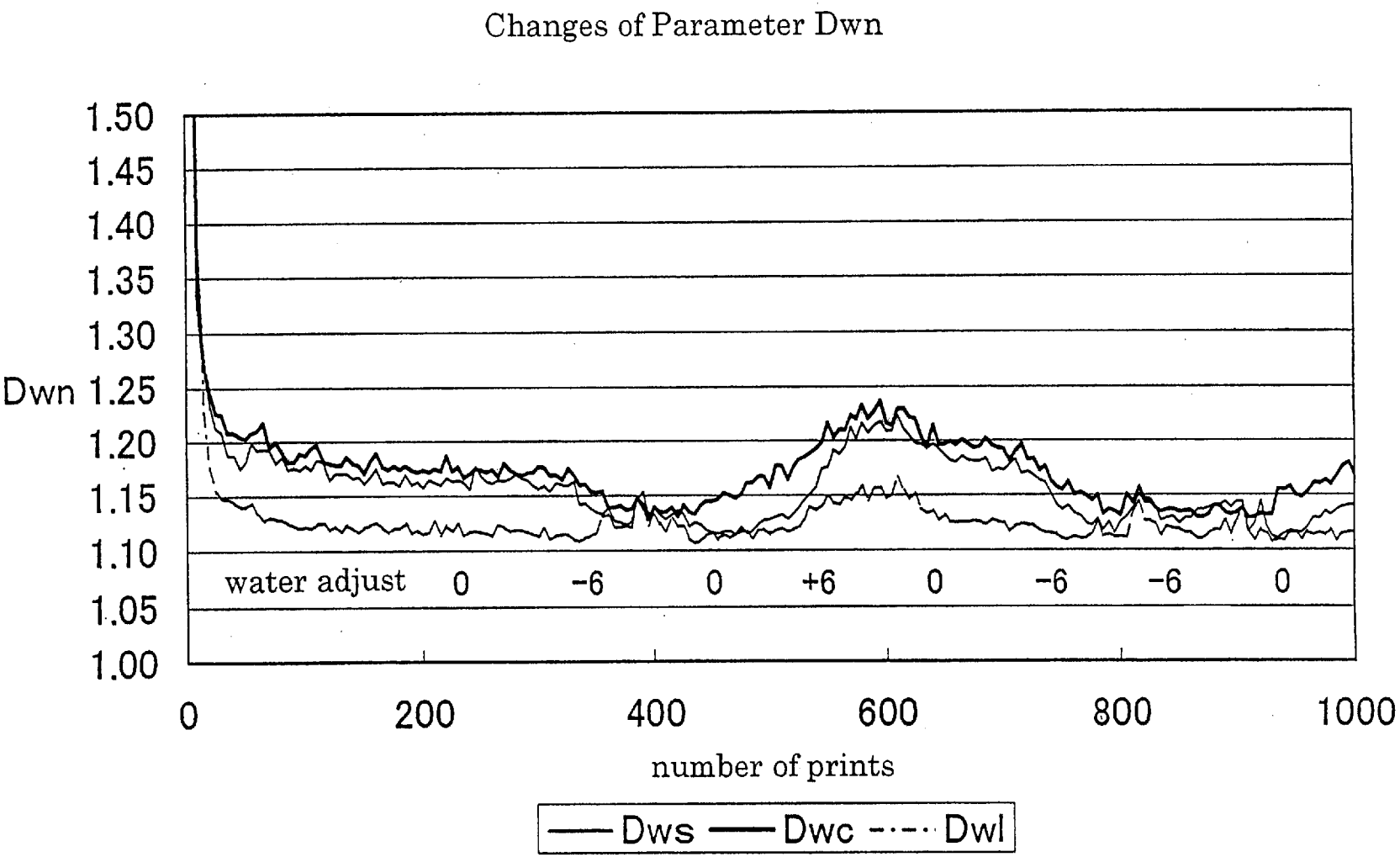
FIG. 17 is a graph showing changes of parameters Dws and Dwl at opposite ends in the direction of printing width occurring with variations in the feed rate of dampening water.

FIG. 17 is a graph showing parameters Dwc, Dws and Dwl computed by using the parameter Dwn determined in the second embodiment.

Next, a difference Dwz between the parameter Dwc for the middle and parameters Dws and Dwz for the opposite ends is determined. As seen from the following equation, difference Dwz is determined by subtracting a mean value of parameters Dws and Dwl for the opposite ends from the parameter Dwc for the middle:

$$Dwz=Dwc-(Dws+Dwl)/2$$

Next, a water quantity estimate Dwv is computed from the following equation for determining whether the feed rate of dampening water is proper or not:

$$Dwv=A\times Dwz+B\times Dwc+C$$

where A, B and C are weight coefficients obtained experimentally.

This equation, with the preceding equation substituted for Dwz, provides the following equation (7):

$$Dwv=A\times\{Dwc-(Dws+Dwl)/2\}+B\times Dwc+C \quad (7)$$

Figure 18:
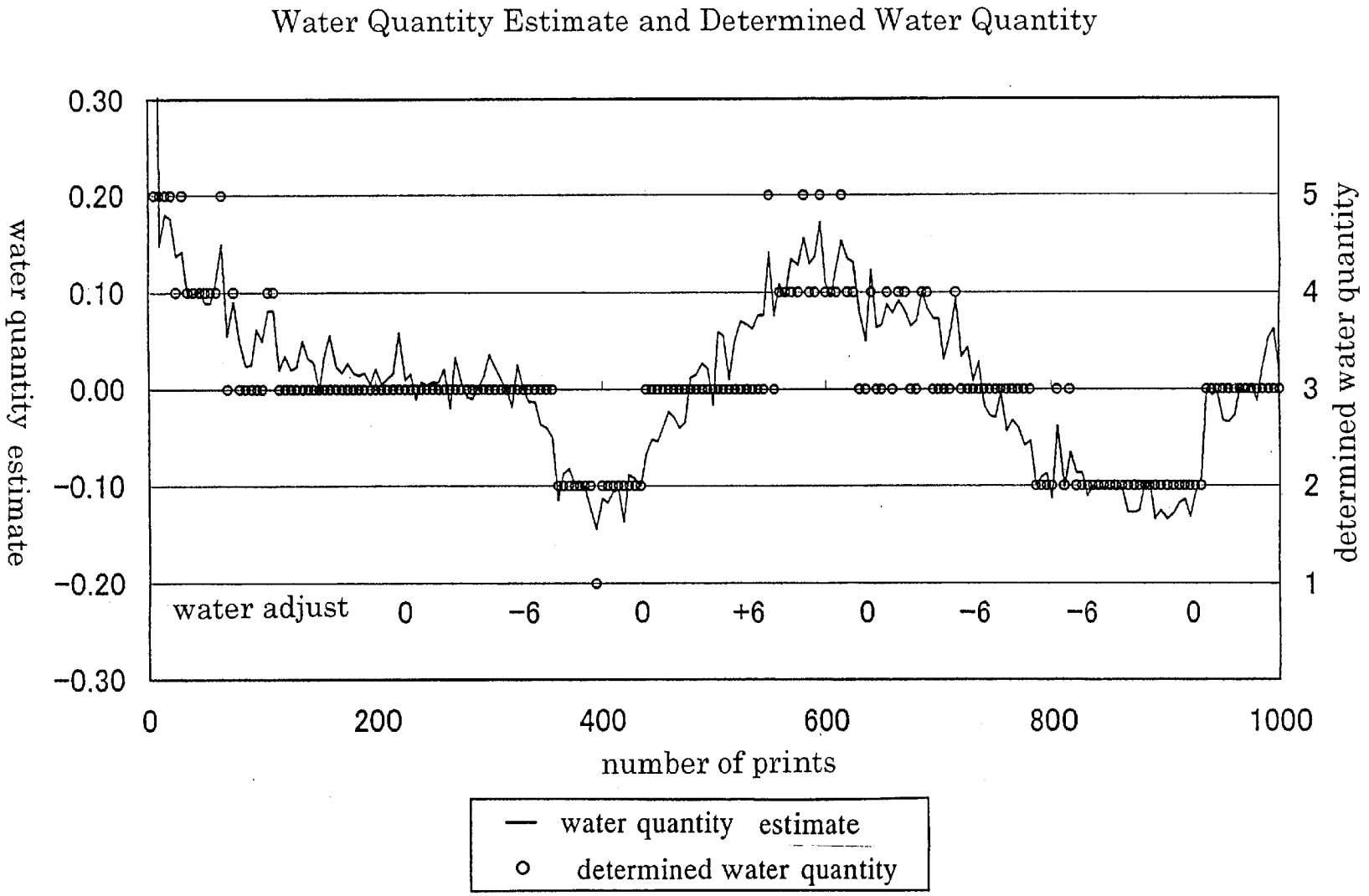
FIG. 18 is a graph showing changes of water quantity estimate Dwv and a determined water quantity value occurring with variations in the feed rate of dampening water.

FIG. 18 is a graph showing the water quantity estimate Dwv derived from the results of computation shown in FIG. 17. In this instance, the coefficients are A=2, B=2 and C=−2.4.

Next, it is determined whether or not the water quantity estimate Dwv obtained is in a predetermined range of levels to determine whether the feed rate of dampening water rate is proper. For example, the levels are divided into the following five stages to be displayed to the operator. When the water quantity estimate Dwv is greater than 0.14, the level is regarded as a fifth stage where dampening water is fed at an excessive rate. When the water quantity estimate Dwv is greater than 0.08 but does not exceed 0.14, the level is regarded as a fourth stage where dampening water is fed at a somewhat high rate but within an appropriate range. When the water quantity estimate Dwv is −0.05 or more but does not exceed 0.08, the level is regarded as a third stage where dampening water is fed at a proper rate. When the water quantity estimate Dwv is −0.14 or more but less than −0.15, the level is regarded as a second stage where dampening water is fed at a somewhat low rate but within the appropriate range. When the water quantity estimate Dwv is less than −0.14, the level is regarded as a first stage where dampening water is fed at an insufficient rate.

In FIG. 18, the water quantity estimate Dwv is divided based on computed values thereof into the five stages 1 to 5 for display, and is plotted in circles in the graph. This five stage display roughly follows timing of water adjustments. It will be seen that the display provides determined water quantity values in a practical range.

Further, based on a difference between the parameters Dws and Dwl for the opposite ends, a balancing adjustment may be made for the right and left ends of the dampening water feeder 21. That is, based on a difference between the parameters Dws and Dwl for the opposite ends, a nip pressure between the water rollers 33 and 34 (or a nip pressure between the fountain roller 32 and water roller 33) of the dampening water feeder 21 may be adjusted at the opposite, right and left, ends of these rollers separately. To effect such an adjustment of the nip pressure at the right and left ends of the rollers, a mechanism may be provided for fine-adjusting positions of bearings supporting the opposite ends of the rollers. With this arrangement, the feed rate of dampening water may be adjusted in a balanced way, for example, by comparing the parameters Dws and Dwl.

The present invention may be embodied in other specific forms without departing from the spirit or essential attributes thereof and, accordingly, reference should be made to the appended claims, rather than to the foregoing specification, as indicating the scope of the invention.

The present application claims priority benefit under 35 U.S.C. Section 119 of Japanese Patent Applications No. 2001-94697 filed in the Japanese Patent Office on Mar. 29, 2001 and No. 2001-316296 filed in the Japanese Patent Office on Oct. 15, 2001, the entire disclosure of which is incorporated herein by reference.

What is claimed is:

1. A method of feeding dampening water in a printing machine for controlling a feed rate of dampening water along with a feed rate of ink by using a plurality of first and second detecting patches printed adjacent each other on printed matter and presenting a difference in density variations after printing with varied feed rates of damping water and ink, said method comprising:

a density measuring step for measuring densities of said first and second detecting patches;

a dampening water feeding step for controlling the feed rate of dampening water based on the densities of said first and second detecting patches measured in said density measuring step; and an ink feeding step for controlling the feed rate of ink based on the densities of said first and second detecting patches measured in said density measuring step, and said feed rate of dampening water determined in said dampening water feeding step.

2. A method as defined in claim 1, wherein:

said dampening water feeding step includes:

a first computing step for computing an adjusted feed rate of dampening water for causing the densities of said first and second detecting patches to approach predetermined densities, respectively; and a dampening water feed rate adjusting step for adjusting the feed rate of dampening water based on the adjusted feed rate of dampening water obtained in said first computing step; and said ink feeding step includes:

an ink density converting step for converting said adjusted feed rate of dampening water to an ink density variation occurring when dampening water is adjusted based on said adjusted feed rate;

a second computing step for computing a required adjusted feed rate of ink by taking said ink density variation into account for adjusting the densities of said detecting patches measured to target densities; and an ink feed rate adjusting step for adjusting the feed rate of ink based on the adjusted feed rate of ink obtained in said second computing step.

3. A method as defined in claim 2, wherein said first detecting patches comprise one of two types of patches that has a large halftone area ratio, while said second detecting patches comprise the other of the two types of patches that has a small halftone area ratio, said density measuring step including:

a patches density measuring step for measuring a density D1$x$ of said first detecting patches and a density D2$x$ of said second detecting patches from said printed matter;

said first computing step includes:

a parameter computing step for computing a parameter Dwx from said densities D1$x$ and D2$x$; and an adjusted dampening water feed rate computing step for computing the adjusted feed rate of dampening water based on said parameter Dwx.

4. A method as defined in claim 3, wherein said first computing step is preceded by a computational expression deriving step for providing coefficients to be used in computing said parameter Dwx in said parameter computing step, based on the densities of said first and second patches obtained by performing printing a plurality of times while varying the feed rates of dampening water and ink.

5. A method as defined in claim 4, wherein said computational expression deriving step includes:

a critical density measuring step for measuring a critical density DM at which a shortage of dampening water causes a defective print, from prints obtained by performing printing a plurality of times while varying the feed rate of dampening water;

a preparatory density measuring step for measuring the density D1$x$ of said first detecting patches and the density D2$x$ of said second detecting patches from each of prints obtained by performing printing a plurality of times while varying the feed rate of ink; and a multiple linear regression step for deriving coefficients a, b and c from the following equation (1) representing the parameter Dwx, by multiple linear regression, using the critical density DM measured in said critical density measuring step, and the density D1$x$ of said first detecting patches and the density D2$x$ of said second detecting patches measured in said preparatory density measuring step in time of each printing:

$$Dwx=DM-\mathrm{D1}x=a\cdot\mathrm{D1}x+b\cdot\mathrm{D2}x+c \quad (1).$$

6. A method as defined in claim 3, wherein said parameter Dwx is regarded as the ink density variation occurring when dampening water is adjusted in said ink density converting step, said second computing step being executed to compute the adjusted feed rate of ink by using a target density DT and said parameter Dwx.

7. A method of feeding dampening water in a printing machine for controlling a feed rate of dampening water along with a feed rate of ink by using two types of detecting patches printed adjacent each other in areas and arranged in a direction of width of printed matter and presenting a difference in density variations after printing with varied feed rates of damping water and ink;

wherein one of said two types of detecting patches has a large halftone area ratio and comprises first detecting patches, while the other of said two types of detecting patches has a small halftone area ratio and comprises second detecting patches;

said method comprising:

a critical density measuring step for measuring a critical density DM at which a shortage of dampening water causes a defective print, from prints obtained by performing printing a plurality of times while varying the feed rate of dampening water;

a preparatory density measuring step for measuring a density D1$x$ of said first detecting patches and a density D2$x$ of said second detecting patches from each of prints obtained by performing printing a plurality of times while varying the feed rate of ink;

a multiple linear regression step for deriving coefficients a, b and c from an equation (1) set out below and representing a parameter Dwx, by multiple linear regression, using the critical density DM measured in said critical density measuring step, and the density D1$x$ of said first detecting patches and the density D2$x$ of said second detecting patches measured in said preparatory density measuring step in time of each printing;

a density measuring step for measuring a density D1$x$ of each of said first detecting patches and a density D2$x$ of each of said second detecting patches arranged in said areas, from printed matter obtained by trial printing;

a parameter computing step for computing the parameter Dwx for each of said areas, by using the equation (1) set out below, from the coefficients a, b and c obtained in said multiple linear regression step, and the density D1$x$ of each of said first detecting patches and the density D2$x$ of each of said second detecting patches obtained in said density measuring step;

a dampening water feed rate adjusting step for adjusting the feed rate of dampening water based on a minimum parameter minDwx of parameters Dwx for said areas obtained in said parameter computing step;

an adjusted ink feed rate computing step for computing an adjusted ink feed rate a for each of said areas, by using an equation (2) set out below and representing the adjusted ink feed rate α, from a target density DT, the critical density DM obtained in said critical density measuring step, the parameter Dwx for each of said areas obtained in said parameter computing step, and the minimum parameter minDwx of parameters Dwx for said areas obtained in said parameter computing step; and an ink feed rate adjusting step for adjusting the feed rate of ink for each of said areas based on the adjusted ink feed rate α obtained in said adjusted ink feed rate computing step:

$$Dwx=DM-\mathrm{D1}x=a\cdot\mathrm{D1}x+b\cdot\mathrm{D2}x+c \quad (1)$$

$$\alpha=DT-DM+(Dwx-\min Dwx) \quad (2).$$

8. A method of feeding dampening water in a printing machine for controlling a feed rate of dampening water along with a feed rate of ink by using three types of detecting patches printed adjacent one another in areas, arranged in a direction of width of printed matter and presenting differences in density variations after printing with varied feed rates of damping water and ink;

wherein one of said three types of detecting patches has a large halftone area ratio and comprises first detecting patches, another of said three types of detecting patches has a smaller halftone area ratio than said first detecting patches and comprises second detecting patches, and the remaining type of detecting patches has a smaller halftone area ratio than said first detecting patches and a different resolution to said second detecting patches and comprise third detecting patches;

said method comprising:

a critical density measuring step for measuring a critical density DM at which a shortage of dampening water causes a defective print, from prints obtained by performing printing a plurality of times while varying the feed rate of dampening water;

a preparatory density measuring step for measuring a density D1$x$ of said first detecting patches, a density D2$x$ of said second detecting patches a density D3$x$ of said third detecting patches from each of prints obtained by performing printing a plurality of times while varying the feed rate of ink;

a multiple linear regression step for deriving coefficients d, e, f and g from an equation (3) set out below and representing a parameter Dwx, by multiple linear regression, using the critical density DM measured in said critical density measuring step, and the density D1$x$ of said first detecting patches, the density D2$x$ of said second detecting patches and the density D3$x$ of said third detecting patches measured in said preparatory density measuring step in time of each printing;

a density measuring step for measuring a density D1$x$ of each of said first detecting patches, a density D2$x$ of each of said second detecting patches and a density D3$x$ of each of said third detecting patches arranged in said areas, from printed matter obtained by trial printing;

a parameter computing step for computing the parameter Dwx, by using the equation (3) set out below, from the coefficients d, e, f and g obtained in said multiple linear regression step, and the density D1$x$ of each of said first detecting patches, the density D2$x$ of each of said second detecting patches and the density D3$x$ of each of said third detecting patches obtained in said density measuring step;

a dampening water feed rate adjusting step for adjusting the feed rate of dampening water based on the parameters Dwx obtained in said parameter computing step; and an ink feed rate adjusting step for adjusting the feed rate of ink based on a target density DT, and the parameter Dwx obtained in said parameter computing step:

$$Dwx=DM-\mathrm{D1}x=d\cdot\mathrm{D1}x+e\cdot\mathrm{D2}x+f\cdot\mathrm{D3}x+g \quad (3).$$

9. A method of feeding dampening water in a printing machine for controlling a feed rate of dampening water by using two types of detecting patches printed adjacent each other on printed matter and presenting a difference in density variations after printing with varied feed rates of damping water;

wherein said two types of detecting patches comprise first detecting patches having a halftone area ratio at substantially 100%, and second detecting patches having a halftone area ratio at K×100% K being a coefficient larger than 0 and smaller than 1;

said method comprising:

a density measuring step for measuring a density Ds of said first detecting patches and a density Dm from said printed matter;

a coefficient computing step for computing a coefficient N, by using Yule-Nielsen's equation (4) set out below, from results of measurement obtained in said density measuring step; and a dampening water feed rate adjusting step for adjusting the feed rate of dampening water based on said coefficient N:

$$Dm=-N\cdot Log\{1-K(1-10^{(-Ds/N)})\} \quad (4).$$

10. A method as defined in claim 9, further comprising a parameter computing step for computing a parameter Dwn from said coefficient N, said dampening water feed rate adjusting step being executed to adjust the feed rate of dampening water based on said parameter Dwn.

11. A method as defined in claim 10, wherein said parameter Dwn is computed from said coefficient N and one of said density Ds and said density Dm.

12. A method as defined in claim 10, wherein said parameter Dwn is derived from the following equation (5):

$$Dwn=1/(1-10^{(-Ds/N)}) \quad (5).$$

13. A method as defined in claim 10, wherein said two types of detecting patches are arranged at least in three areas in a direction of printing width; and further comprising a third computing step for computing a water quantity estimate Dwv based on parameters Dws and Dwl for said end areas and a parameter Dwc for said middle area determined by using the computation for the parameter Dwn in said second computing step;

said dampening water feed rate adjusting step being executed to adjust the feed rate of dampening water based on said water quantity estimate Dwv.

14. A method as defined in claim 13, wherein said water quantity estimate Dwv is computed from the following equation (7):

$$Dwv=A\times\{Dwc-(Dws+Dwl)/2\}+B\times Dwc+C \quad (7)$$

where A, B and C are predetermined coefficients.

15. A method as defined in claim 13, wherein said parameters Dws and Dwl for said end areas are used in adjusting nip pressures of dampening water rollers arranged in the direction of printing width.

16. A method as defined in claim 9, wherein said equation (4) is solved by using the following equation (6) for approximate calculation:

$$Dm=-N\cdot Log\{1-K(1-10^{-Ds})\} \quad (6).$$

* * * * *